United States Patent [19]

Effenberger et al.

[11] Patent Number: 4,770,927

[45] Date of Patent: Sep. 13, 1988

[54] REINFORCED FLUOROPOLYMER COMPOSITE

[75] Inventors: John A. Effenberger, Bennington, Vt.; Frank M. Keese, Hoosick Falls, N.Y.

[73] Assignee: Chemical Fabrics Corporation, Merrimack, N.H.

[21] Appl. No.: 864,557

[22] Filed: May 15, 1986

Related U.S. Application Data

[63] Continuation of Ser. No. 600,002, Apr. 13, 1984, abandoned, which is a continuation-in-part of Ser. No. 484,594, Apr. 13, 1983, abandoned.

[51] Int. Cl.[4] ..... B23B 17/04; B05D 5/00

[52] U.S. Cl. ..... 428/245; 428/246; 428/251; 428/252; 428/284; 428/285; 428/286; 428/287; 428/421; 428/422; 428/408; 428/375; 428/392; 428/394; 428/395; 428/379; 428/367; 428/383

[58] Field of Search ..... 428/252, 245, 421, 422, 428/246, 284, 251, 285, 286, 287, 408, 375, 392, 394, 395, 379, 383, 367

[56] References Cited

U.S. PATENT DOCUMENTS

| | | | |
|---|---|---|---|
| 2,681,324 | 6/1954 | Hochberg . | |
| 2,710,266 | 6/1955 | Hochberg . | |
| 3,019,206 | 1/1962 | Robb . | |
| 3,136,680 | 6/1964 | Hochberg . | |
| 3,306,155 | 2/1967 | Zumeta et al. . | |
| 3,501,360 | 3/1970 | Mancel . | |
| 3,513,064 | 5/1970 | Westley . | |
| 3,673,054 | 6/1972 | Wright et al. . | |
| 3,692,558 | 9/1972 | Werner . | |
| 3,692,569 | 9/1972 | Grot . | |
| 3,755,057 | 8/1973 | Scott . | |
| 3,790,403 | 2/1974 | Ribbans, III | 428/251 |
| 3,849,243 | 11/1974 | Grot | 428/290 |
| 3,850,674 | 11/1974 | Clarke, Jr. et al. | 428/421 |
| 3,899,622 | 8/1975 | Geiger . | |
| 3,904,575 | 9/1975 | Satokawa et al. . | |
| 3,968,297 | 7/1976 | Sauer . | |
| 3,989,873 | 11/1976 | Robertson et al. . | |
| 4,004,059 | 1/1977 | Deiner et al. . | |
| 4,012,551 | 3/1977 | Bogaty et al. . | |
| 4,036,802 | 7/1977 | Poirier . | |
| 4,039,713 | 8/1977 | Vassiliou . | |
| 4,054,704 | 10/1977 | Vassiliou . | |

(List continued on next page.)

FOREIGN PATENT DOCUMENTS 2601569 6/1977 Fed. Rep. of Germany .

*Primary Examiner*—P. C. Ives

*Attorney, Agent, or Firm*—Brumbaugh, Graves, Donohue & Raymond

[57] ABSTRACT

A novel composite comprises a substrate having a coating matrix including an initial layer of a perfluoropolymer and an overcoat comprising a fluoroelastomer, a fluoroplastic, a fluoroelastomer/fluoroplastic blend, or a combination thereof. The perfluoropolymer in the initial layer may be a perfluoroplastic, a perfluoroelastomer, or blends thereof. In a separate embodiment, the novel composite includes a substrate coated solely with one or more layers of perfluoroelastomer alone or as a blend with a perfluoroplastic. Where the substrate is not susceptible to hydrogen fluoride corrosion, the composite may include solely one or more layers of a blend of a fluoroelastomer and a hydrogen-containing perfluoroplastic. Cross-linking accelerators may be used to cross-link one or more of the resins contained in the coating layers. Each composite may be top-coated with a layer or layers of a fluoroplastic, fluoroelastomer, and/or a blend thereof. The composite is flexible, exhibits good matrix cohesion and possesses substantial adhesion of the matrix to the material acting as the reinforcement or substrate. A method for making such a composite comprises the unique deployment of a perfluoropolymer directly onto the substrate in a relatively small amount sufficient to protect the substrate from chemical corrosion without impairing flexibility, followed by the application of the overcoat layer.

38 Claims, 3 Drawing Sheets

U.S. PATENT DOCUMENTS 4,054,705 10/1977 Vassiliou .
4,070,525 1/1978 Vassiliou et al. .
4,087,394 5/1978 Concannon .
4,097,642 6/1978 Dear et al. .
4,100,113 7/1978 McCain .
4,113,912 9/1978 Okita .
4,117,185 9/1978 Cummins et al. .
4,118,532 10/1978 Homsy .
4,120,608 10/1978 Vassiliou .
4,122,226 10/1978 Vassiliou .
4,128,693 12/1978 Dhami et al. .
4,131,711 12/1978 Attwood .
4,143,204 3/1979 Fang .
4,150,008 4/1979 Vassiliou et al. .
4,165,404 8/1979 Quehl .
4,168,298 9/1979 Fitzgerald .
4,177,320 12/1979 Yoshimura et al. .
4,194,041 3/1980 Gore et al. .
4,252,858 2/1981 Chao et al. .
4,252,859 2/1981 Concannon et al. ..... 428/422
4,264,650 4/1981 Schulze et al. .
4,335,238 6/1982 Moore et al. .
4,343,841 8/1982 Close .
4,347,268 8/1982 Close .
4,347,278 8/1982 Plautt et al. ..... 428/391
4,351,882 9/1982 Concannon .
4,355,065 10/1982 DeMott .
4,370,376 1/1983 Gangal et al. .
4,385,085 5/1983 Verzwyvelt .

REINFORCED FLUOROPOLYMER COMPOSITE

This application is a continuation of application Ser. No. 600,002, filed on 4/13/84 now abandoned, which is a continuation-in-part application of U.S. application, Ser. No. 484,594, filed on Apr, 13, 1983 now abandoned.

BACKGROUND OF THE INVENTION

This invention relates to new and useful fluoropolymer composites comprising coated substrates. More particularly, the invention relates to a new fluoroelastomer/fluoroplastic matrix useful as a coating in the manufacture of reinforced woven composites which are flexible, exhibit good matrix integrity, and possess good adhesion or bonding of the coating matrix to the substrate. The invention includes composites which also have extraordinary chemical resistance, particularly at elevated temperatures and in humid environments. The invention further relates to a method of making such composites whereby the desirable high temperature, chemical inertness of fluoroplastic materials is combined with the desirable mechanical properties of fluoroelastomers in such a way as to maintain a desirable fabric-like flexibility.

Perhaps the most well-known subclass of fluoropolymers are substances called "perfluoroplastics" which are generally recognized to have excellent electrical characteristics and physical properties, such as a low coefficient of friction, a low surface free energy (i.e., non-wetting to many organic fluids), and a very high degree of hydrophobicity. Fluoroplastics, and particularly perfluoroplastics (i.e., those fluoroplastics which do not contain hydrogen), such as polytetrafluoroethylene (PTFE), fluoro (ethylene-propylene) copolymer (FEP) and copolymers of tetrafluoroethylene and perfluoro-propyl vinyl ether (PFA), are resistant to a wide range of chemicals, even at elevated temperatures, making them particularly useful in a variety of industrial and domestic applications. However, due to the partially crystalline nature of these fluoroplastics, they exhibit a degree of stiffness or lack of compliance which is detrimental to the utilization of these desirable properties. This shortcoming is particularly noticeable and objectionable in a reinforced composite where some degree of flexibility, elasticity, and/or conformability is necessary.

The broad class of fluoropolymers also includes substances called "fluoroelastomers" which are not only elastomeric, but also possess, although to a lesser degree, the aforementioned physical and electrical properties of a fluoroplastic. Fluoroelastomers, including perfluoroelastomers, have the low flex modulus and conformability which fluoroplastics lack. The hydrogen-containing fluoroelastomers, however, do not maintain other advantageous physical properties associated with fluoropolymers over as broad a temperature range, or at as high a level, as do the perfluoroplastics. In other words, perfluoroplastics simply perform better over a wider temperature range. Moreover, the fluoroelastomers which contain hydrogen (i.e., which are partially fluorinated) generally degrade rapidly at higher temperatures resulting not only in the loss of physical integrity but also in the formation of hydrofluoric acid. Hydrofluoric acid is, of course, highly corrosive to most materials, including those normally used as reinforcing substrates for textile composites, and particularly to fiberglass substrates. For this reason, hydrogen-containing fluoroelastomer based composites presently used in high temperature environments require relatively frequent replacement. Notwithstanding these drawbacks, fluoroelastomers containing hydrogen are considered excellent candidates for use in a variety of commercial applications requiring a lower flex modulus than that possessed by the stiffer fluoroplastics.

In this regard, attempts have been made to employ reinforced fluoroelastomer composites where good thermochemical, as well as mechanical properties, i.e. low modulus, are required at higher temperatures. One such application is in high temperature expansion joints which connect large duct sections in applications such as power plant systems. These ducts have in the past been joined at their section ends by metal bellows which, while basically chemically and thermally sound, provide minimal thermo-mechanical shock resistance under normal operating conditions, which can involve temperatures up to 550° F., or even 650° F. In an effort to improve the mechanical properties of metal expansion joints, the flexibility of an industrial fabric is desired, and fabric composites coated with fluoroelastomer based rubber compounds have been used.

These fabric composites have used various reinforcement materials, including fiberglass fabric, coated with a matrix containing a fluoroelastomer composition based on copolymers of hexafluoropropylene (HFP) and vinylidene fluoride ($VF_2$) or terpolymers including HFP, $VF_2$ and tetrafluoroethylene (TFE). The fluoroelastomer materials used all contain at least some hydrogen and, as such, are susceptible to the shortcomings associated with hydrofluoric acid elimination. Moreover, in order for the prior art fluoropolymer composites to be useful in high temperature, chemically corrosive applications, they customarily incorporate a relatively thick matrix of the fluoroelastomer based rubber, thereby increasing their stiffness and potentially aggravating problems deriving from hydrofluoric acid formation and thermal embrittlement. In an effort to avoid these problems, composites using hydrogen-containing fluoroelastomer compounds are being reinforced with acid resistant alloys such as INCONEL, or high temperature synthetics, such as NOMEX and KEVLAR. None of these composites, however, offer the desired combination of thermal and chemical resistance with acceptable matrix integrity.

Even where chemically insusceptible substrates, such as PTFE, have been coated with fluoropolymers, such as in Westley, U.S. Pat. No. 3,513,064, the resulting composites could only be achieved by selecting specific coating materials as limited by processing conditions, such that the composites possessed properties permitting use only in certain narrow applications.

In the hope of achieving an improved balance of fluoropolymer properties, prior attempts have been made to combine the respective good properties of fluoroplastic and fluoroelastomer materials in the manufacture of coated fabric. But these attempts have produced blends which either suffer the combined disadvantageous properties of the components or exhibit diminished good properties, particularly at higher temperatures, for example above about 500° F. A typical example of these prior attempts is found in U.S. Pat. No. 3,019,206 to Robb.

While perfluoropolymers, whether thermoplastic or elastomeric, possess excellent thermal and chemical stability, it is difficult to form durable bonds between them and other materials due to their low surface free energy and chemical inertness. This difficulty is conventionally obviated by providing roughened surfaces to promote mechanical bonding, such as employing inorganic fillers or abraded surfaces. Specific surface treatments, such as those based upon chemical etching, may also be employed. But none of these known techniques results in bonding which is particularly strong or durable under environmental stresses, such as ultraviolet or thermally induced oxidation.

Accordingly, it is an object of this invention to provide a fluoropolymer composite comprising a substrate coated with a fluoroelastomer/fluoroplastic matrix. The invention composite is flexible, exhibits good matrix cohesion, and possesses excellent adhesion of the matrix to the material acting as the reinforcement or substrate, while maintaining the low stiffness associated with a fluoroelastomer combined with, where desired, the superior high temperature performance of a fluoroplastic.

It is also an object of this invention to provide a fluoropolymer composite which is relatively light, but strong, and which is both chemically and thermally superior, particularly at elevated temperatures and under humid conditions, while ameliorating the polymer degradation problems that have heretofore arisen in the use of composites having a coating matrix based upon a hydrogen-containing fluoroelastomer.

It is a further object of this invention to provide a fluoropolymer composite having outstanding thermochemical properties for use as chemical liners, expansion joints, and life safety devices, such as escape hoods, escape chutes and chemically protective clothing.

It is yet another object of this invention to provide a composite having the combined advantages of perfluoroplastics and fluoroelastomers which can be used to make excellent plied constructions, including multiple biased-plied composites, as well as composites having a single coated face.

SUMMARY OF THE INVENTION

In accordance with the invention, a gradation of fluoropolymer layers is accomplished to form a coating matrix for application to a substrate in the manufacture of a novel composite. The fluoropolymer layers may include perfluoropolymer as well as hydrogen-containing fluoropolymer components which are deployed in a novel and unique way so as to combine as desired the respective advantageous properties of different fluoropolymer components. The hydrogen-containing fluoropolymer components include fluoroplastics, fluoroelastomers and blends of fluoroelastomers and fluoroplastics. The perfluoropolymer component or components are initially applied and provide a hydrogen-free interface such that a substrate material, which might otherwise be susceptible to the potential corrosive effects of hydrogen fluoride generated by any hydrogen-containing fluoropolymer component or otherwise, is shielded from such effects while the basic flexibility of the substrate is maintained. A fluoroplastic component may also comprise the topcoat or surface layer, or a part thereof, where the behavior of a thermoplastic, rather than an elastomer, is desired. Hydrogen-containing fluoroelastomer components are so deployed within the coating matrix so as to be isolated by the perfluoropolymer layer from a substrate potentially susceptible to HF corrosion, yet are so situated as to enhance the flexibility of the resulting composite membrane. When deployed as, or within, the top or surface coat, the fluoroelastomer component also functions to enhance the conformability of the composite and generally to endow the surface with rubber-like characteristics.

The novel reinforced composites according to the invention include a substrate, preferably a textile substrate, coated on one or both faces with a matrix comprising:

(A) an initial layer of a perfluorinated polymer, most preferably a perfluoroplastic, such as PTFE, or a perfluoroelastomer, such as KALREZ (DuPont), or blends thereof; and (B) a further overcoat layer or layers of (1) a fluoroelastomer or perfluoroelastomer; (2) a fluoroplastic or perfluoroplastic; and/or (3) a blend of (i) a fluoroelastomer or perfluoroelastomer, and (ii) a fluoroplastic, preferably a perfluoroplastic, such as PTFE, wherein the fluoroelastomer or perfluoroelastomer comprises about 10–90% by weight of the blend, preferably about 25 to 60% by weight.

In a separate embodiment of the invention, the novel composites will include a substrate coated solely with one or more layers of perfluoroelastomer alone or as a blend with a perfluoroplastic. Moreover, where the substrate is not susceptible to HF corrosion, the composite may include solely one or more layers of a blend of hydrogen-containing fluoroelastomer and a perfluoroplastic.

In other embodiments of the invention, the basic coating matrix will comprise elements A and B as set forth above having a multitude of fluoropolymer coating layers all strategically deployed to achieve the desired properties. In those embodiments wherein a substrate is coated with a matrix on only one face, the substrate may be adhered to a different substrate on its other face. Each composite according to the invention may be topcoated with a layer or layers of a fluoroelastomer, fluoroplastic and/or a blend of a fluoroplastic and fluoroelastomer which may be different in composition from any overcoat blend.

In addition, relatively small amounts of crosslinking accelerators, such as triallyl isocyanurate, triallyl imidazole, and the like, may be used to cross-link one or more of the resins contained in the coating layers, as desired, by use of high energy electrons or actinic irradiation.

The composites made in accordance with various embodiments of the invention are characterized by good matrix cohesion and adhesion between the substrate and the fluoropolymer matrix. Composites may also be prepared which possess extraordinary resistance to thermal and/or chemical degradation and accomodation to thermo-mechanical shock. Invention composites require much less coverage, i.e. reduced coating thickness, than similar prior art composites so as to provide a lighter and/or thinner, yet stronger product.

Any suitable reinforcement material capable of withstanding processing temperatures may be employed as a substrate. Examples include, inter alia, glass, fiberglass, ceramics, graphite (carbon), PBI (polybenzimidazole), PTFE, polyaramides, such as KEVLAR and NOMEX, metal wire, polyolefins such as TYVEK, polyesters such as REEMAY, polyamides, polyimides, novoloid phenolic fibers, thermoplastics such as KYNAR, TEFZEL, and KYNOL, polyether sulfones polyether imides, polyether ketones, cotton, cloth and other natural as well as synthetic textiles. The substrate may comprise a yarn, filament, monofilament or any other fibrous material either as such or assembled as a textile, or any woven, non-woven, knitted, matted, felted, etc. material. Depending upon the nature of the substrate and the intended end use of the composite, the reinforcement or substrate is impregnated, either initially or simultaneously with the initial polymer layer, with a suitable lubricant or saturant, such as methylphenyl silicone oil, graphite, a highly fluorinated fluid, such as FLUOROLUBE or KRYTOX, and the like, and may include a coupling agent. The lubricant or saturant performs three functions vis-a-vis the reinforcing substrate:

(1) As a lubricant, it protects the substrate from self-abrasion by maintaining the mobility of the reinforcing elements;

(2) As a saturant, it inhibits extensive penetration of the initial polymer coat into the substrate which could reduce flexibility; and (3) In a finished product, it remains in the substrate to inhibit wicking of moisture or other degrading chemicals through the substrate. The lubricant or saturant may either be applied separately as an initial pass or in combination with the first application of perfluoropolymer component.

The invention also encompasses a novel method of making invention composites which provides for the unique deployment of the various coating layers comprising the matrix, as heretofore described, particularly so as to minimize the deleterious effects of any hydrogen fluoride generated by a hydrogen-containing fluoroelastomer or fluoroplastic component and to maintain good overall composite flexibility. As such, the method results in the achievement of an improved product having a low modulus of stiffness and good chemical resistance applicable over a broad range of temperatures for a variety of end uses.

DETAILED DESCRIPTION

The initial layer, described as element A above, is applied so as to minimize the stiffness of the final composite and to maximize adhesion of the matrix to the substrate. The application of the layer A may be accomplished in one or more passes and, preferably, any openings in an assembled substrate will remain substantially open in order to enhance flexibility, particularly where any additional overcoat layer or layers according to element B are contemplated. In instances where the substrate to be employed is an assembled, fibrous material, the initial coating layer may be applied to the elements of the material (e.g. filament or yarn) prior to their assembly, by e.g. dip coating, impregnating or by extrusion coating. Thereafter, such materials may be assembled by weaving, knitting, felting, matting, etc.

In those embodiments which include both a hydrogen-containing fluoropolymer and a chemically-susceptible substrate, such as one which is susceptible to HF, the perfluorinated initial layer should be sufficient to substantially protect the reinforcing substrate, and in particular, a fiberglass substrate, from chemicals such as hydrogen fluoride which may be encountered. Again, depending on the substrate, additional thin layers of perfluoropolymer may be applied to insure that the reinforcement has an adequate protective layer. With the proper selection, application, and deployment of the coating layers, the penetration of aggressive chemicals such as hydrogen fluoride is impeded by the protective hydrogen-free perfluoropolymer interface, while flexibility is maintained.

The initial coating is then covered with a layer or layers of a fluoroplastic, fluoroelastomer, a fluoroelastomer/fluoroplastic blend or any combination thereof, as element B described above. Preferably, this portion of the matrix includes a layer or layers of a blend containing the fluoroelastomer in such proportions so as to impart the desired balance of fluoropolymer properties to the composite. For example, where a composite having more pronounced elastomeric properties is desired, increased proportions of the fluoroelastomer are used in the blend. It has been found that through the combination of the layer A and the layer B, particularly employing the fluoroelastomer/fluoroplastic blend according to the invention, adequate cohesion within the matrix itself as well as matrix to substrate adhesion is often achieved by thermal means alone without any prior physical or chemical treatment of the substrate or individual matrix layers and without the use of adhesion promoters. Through the use of the invention matrix and the particular deployment of the layers thereof vis-a-vis each other and the substrate in accordance with the invention method, the ability to maintain an adequate degree of adhesion is achieved, while maintaining flexibility and the desired properties of the different fluoropolymer components of the matrix. This same feature allows for the selection of a top coat or surface layer having the attributes of a fluoroplastic or a fluoroelastomer, or any combination thereof, as may be desired.

Accordingly, once the initial and overcoat layers have been deployed, a topcoat of either a fluoroplastic or any additional fluoroelastomer layer may thereafter be applied. A surface coat of a perfluoroplastic, such as PTFE, or a perfluoroelastomer, such as KALREZ, or the fluoropolymer blend coatings containing copolymers of perfluorinated polyvinyl ether described in U.S. Pat. No. 4,252,859 to Concannon et al., imparts better thermal properties and chemical resistance than, for example, the embodiment having a hydrogen-containing fluoroelastomer or blend thereof.

Coating layers of the invention matrix may be applied by dip coating from an aqueous dispersion, but any conventional method, such as spraying, dipping, and flow coating, from aqueous or solvent dispersion, calendering, laminating and the like, may be employed to form the coating, as is well-known in the art.

The term "fluoroplastic" as used herein shall encompass both hydrogen-containing fluoroplastics and hydrogen-free perfluoroplastics, unless otherwise indicated. Fluoroplastic means polymers of general paraffinic structure which have some or all of the hydrogen replaced by fluorine, including inter alia polytetrafluoroethylene (PTFE), fluorinated ethylene propylene (FEP) copolymer, perfluoroalkoxy (PFA) resin, homopolymers of polychlorotrifluoroethylene (PCTFE) and its copolymers with TFE or $VF_2$, ethylenechlorotrifluoroethylene (ECTFE) copolymer and its modifications, ethylene-tetrafluoroethylene (ETFE) copolymer and its modifications, polyvinylidene fluoride (PVDF), and polyvinylfluoride (PFV).

Similarly, the term "fluoroelastomer" as used herein shall encompass both hydrogen-containing fluoroelastomers as well as hydrogen-free perfluoroelastomers, unless otherwise indicated. Fluoroelastomer means any polymer with elastomeric behavior or a high degree of compliance, and containing one or more fluorinated monomers having ethylenic unsaturation, such as vinylidene fluoride, and one or more comonomers containing ethylenic unsaturation. The fluorinated monomer may be a perfluorinated mono-olefin, for example hexafluoropropylene, tetrafluoroethylene, and perfluoroalkyl vinyl ethers, e.g. perfluoro (methyl vinyl ether) or (propyl vinyl ether). The fluorinated monomer may be a partially fluorinated mono-olefin which may contain other substituents, e.g. chlorine or hydrogen, the mono-olefin is preferably a straight or branched chain compound having a terminal ethylenic double bond. The elastomer preferably consists of units derived from fluorine-containing monomers. Such other monomers include, for example, olefins having a terminal ethylenic double bond, especially ethylene and propylene. The elastomer will normally consist of carbon, hydrogen, oxygen and fluorine atoms.

Any fluoropolymer component may contain a functional group such as carboxyl, and sulfonic acid and salts thereof, halogen as well as a reactive hydrogen on an alkyl side chain.

Preferred elastomers are copolymers of vinylidene fluoride and at least one other fluorinated monomer, especially one or more of hexafluoropropylene, pentafluoropropylene, tetrafluoroethylene and chlorotrifluoroethylene. Available fluoroelastomers include copolymers of vinylidene fluoride and hexafluoropropylene, and terpolymers of vinylidene fluoride, hexafluoropropylene and tetrafluoroethylene, sold by DuPont as VITON and by 3M as FLUOREL and by Daiken as DAIEL. Additionally, elastomeric copolymers of vinylidene fluoride and chlorotrifluoroethylene are available from 3M as Kel-F. The use of AFLAS, which is a copolymer of TFE and propylene, as manufactured by Asahi, is also contemplated.

Preferred perfluoroelastomers include elastomeric copolymers of tetrafluoroethylene with perfluoro alkyl comonomers, such as hexafluoropropylene or perfluoro (alkyl vinyl ether) comonomers represented by F

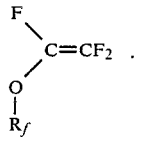

in which $R_f$ is a perfluoroalkyl or perfluoro (cyclo-oxa alkyl) moiety. Particularly preferred are the perfluorovinyl ethers in which $R_f$ is selected from the groups $-CF_3$, $-C_3F_7$,

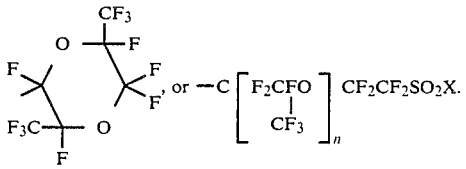

where n=1–4 and X=H, Na, K or F. Particularly contemplated is KALREZ is a copolymer including TFE and perfluoromethylvinyl ether (PMVE). If desired, and as is well-known in the art, fillers or additives such as pigments, plasticizers, stabilizers, softeners, extenders, and the like, can be present in the matrix composition. For example, there can be present substances such as graphite, carbon black, titanium dioxide, alumina, alumina trihydrate, glass fibers, beads or microballoons, carbon fibers, magnesia, silica, asbestos, wollastonite, mica, and the like. The deployment of the various matrix layers upon the substrate in accordance with the invention is essentially accomplished by a method which comprises the steps of:

1. If necessary or desired, removing the sizes or finishes from the substrate material, for example, in the instance of woven fiberglass, by heat cleaning the substrate or scouring a woven synthetic fabric.

2. Applying, as an initial layer to one or both faces of the substrate, a perfluoropolymer, preferably a perfluoroplastic such as PTFE or a perfluoroelastomer, such as KALREZ, or blends thereof. As heretofore noted, in one embodiment of the invention one or more layers of perfluoroelastomer, or a blend thereof as previously disclosed, may simply be applied to the substrate to prepare a composite. As hereinbefore discussed, a suitable saturant or lubricating agent, preferably methylphenyl silicone oil, typically in a mixture containing 2–14 parts by weight lubricant, may also be applied to the substrate either initially or simultaneously with the perfluoropolymer. In instances where sufficient flexibility otherwise exists, a coupling agent may be used to enhance the adhesion of the matrix to the substrate, as desired. As previously set forth, the initial coating is applied so to minimize the stiffness of the composite and which may be a relatively light application depending upon the weight and openness of the substrate. As indicated above, where the substrate is coated on only one face, the other face of the substrate may be adhered to a different substrate material.

3. Applying, in one or more layers, as an overcoat to the initial layer, a fluoroplastic, a fluoroelastomer, a blend of a fluoroelastomer and a fluoroplastic, preferably a perfluoroplastic, such as PTFE, or any combination thereof. Where a fluoroelastomer/fluoroplastic blend is used, either alone or as a layer on top of a fluoroelastomer layer, the blend should contain about 10–90% by weight of the fluoroelastomer component, preferably 25–60% by weight.

4. If desired, applying a topcoat of either a fluoroplastic, again preferably a perfluoroplastic such as PTFE or its melt-fabricable copolymers of TFE or a topcoat of an additional layer of a fluoroelastomer, preferably a perfluoroelastomer, or fluoroelastomer/fluoroplastic blend.

5. Optionally, applying a surface coating of a fluoroplastic in greater thicknesses by extruding or laminating a melt processible film such as PTFE, FEP or PFA, or a fluoroelastomer such as VITON, AFLAS, or KALREZ. Moreover, it is clearly an advantage that the composites of the present invention may be produced, if so desired, by aqueous dispersion techniques. The process may be carried out under the conditions by which the cohesiveness of the matrix and adhesion to the substrate is thermally achieved. A preferred process for the manufacture of invention composites comprises an initial application of a perfluoropolymer from a latex or dispersion to a suitably prepared substrate at temperatures leading to fusing or consolidation of the applied polymer Following this initial coat, an overcoat comprising a fluoroelastomer, a fluoroplastic, or blends of fluoroelastomer and fluoroplastic derived from a latex or dispersion blend, is applied in such a manner as to dry the coating, but not to exceed the upper temperature limits of its most thermally labile component. The resulting, partially consolidated coating layers may then be subjected to more modest heat under pressure to further consolidate or strengthen the applied coating. Calendering is a convenient process to achieve this result. The topcoat is then applied at a temperature required to fuse the component with the highest melting point in order to complete consolidation with minimal heat exposure for the most thermally labile components. A latex is often available for this operation. Optionally, an uppermost coating may be applied by extrusion coating, calendering, or laminating the polymeric components on to the previously consolidated coating. Extrusion coating is most desirable when a foamed topcoat is desired.

It should be understood that in any embodiment according to the invention, the uppermost or surface layer may be applied as a foam to enhance compressibility or to increase thickness at low density.

The following additives may be included in the process for making the matrix composition: a surface active agent such as an anionic active agent or a non-ionic active agent; a creaming agent such as sodium or ammonium alginate; a viscosity-controlling agent or a thickener such as methyl cellulose or ethyl cellulose; a wetting agent such as a fluorinated alkylcarboxylic acid, an organic solvent, or sulfonic acid; or a film former.

The achievement of the remarkable properties of the invention composites is further explained and illustrated below with reference to the accompanying drawings in which:

BRIEF DESCRIPTION OF THE DRAWINGS

In FIG. 1, the previously assembled (woven) yarn 10, having first been treated with silicone oil, is coated with a fluoropolymer initial coating layer 12 which completely covers both the warp 14 and fill 16 of the yarn 10. The layer 12 is then covered with an overcoat layer 18 comprising a blend of fluoroelastomer and fluoroplastic. The resulting composite may be further coated with an optional fluoroplastic or fluoroelastomer topcoat 20 as shown.

FIG. 1A shows a side view section of a woven composite wherein initial coating layer 12 is applied to the yarn prior to assembly (weaving) and completely surrounds and jackets the yarn 10. Such a composite may have enhanced flexibility, depending on the nature of coating layer 12.

FIG. 2 shows the deployment of the various layers of a coating matrix according to one embodiment of the invention wherein the substrate is woven. An enlarged section of a plain woven substrate is shown wherein both the warp 14 and fill 16 of the yarn 10 are initially coated with a light layer of lubricant (not shown) and fluoropolymer 22. The layer 22 is displayed in such a way as to cover and protect the yarn 10, while leaving the openings 24 in the woven substrate free and clear so as not to substantially diminish the overall flexibility of the final composite. To the initially coated substrate is then applied an overcoat layer 26 of a fluoroelastomer/-fluoroplastic blend according to the invention which covers the yarn 10, including the warp 14 and fill 16, as well as the openings 24 which, when filled with the more elastic blend layer 26, imparts a lower flex modulus to the resulting composite.

Figure 1:
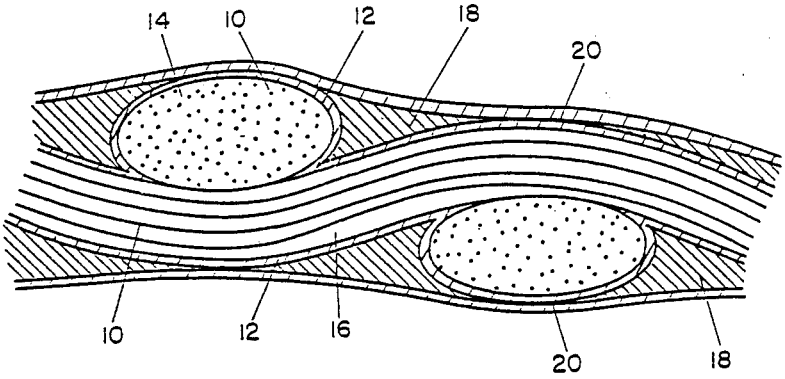
FIGS. 1 and 1A show enlarged schematic side view sections of woven composites by which several embodiments according to the invention are shown and illustrated.
Figure 2:
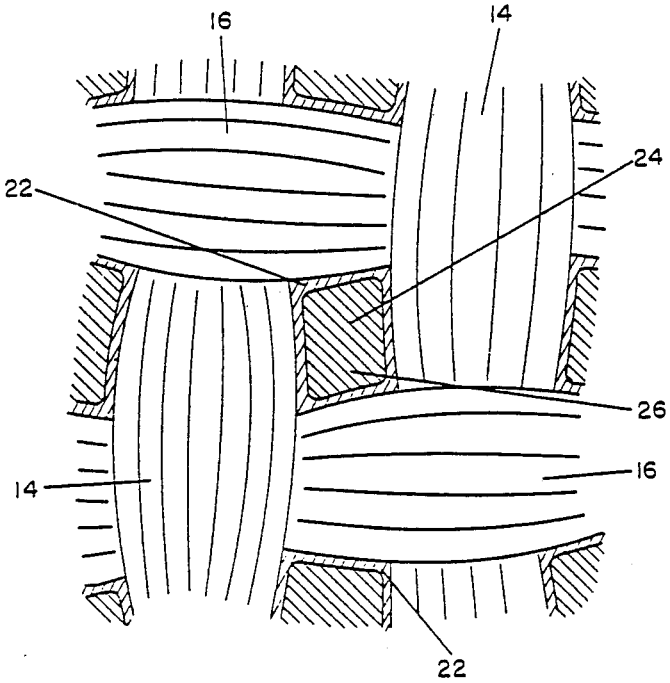
FIG. 2 is an enlarged schematic plan view of a cross-section of an open weave fiberglass composite coated according to an embodiment of the invention.
Figure 1A:
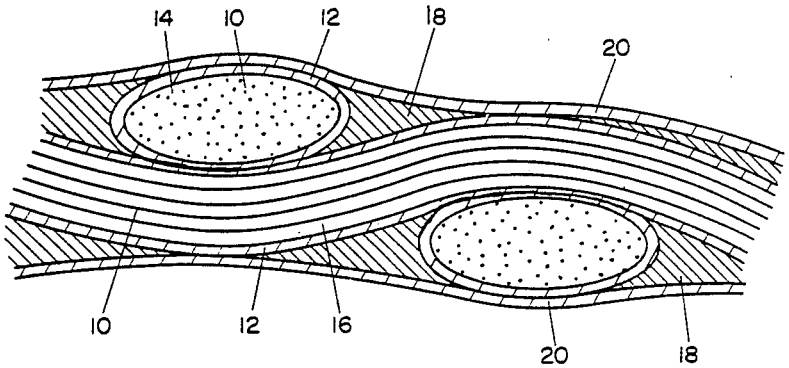
Figure 3:
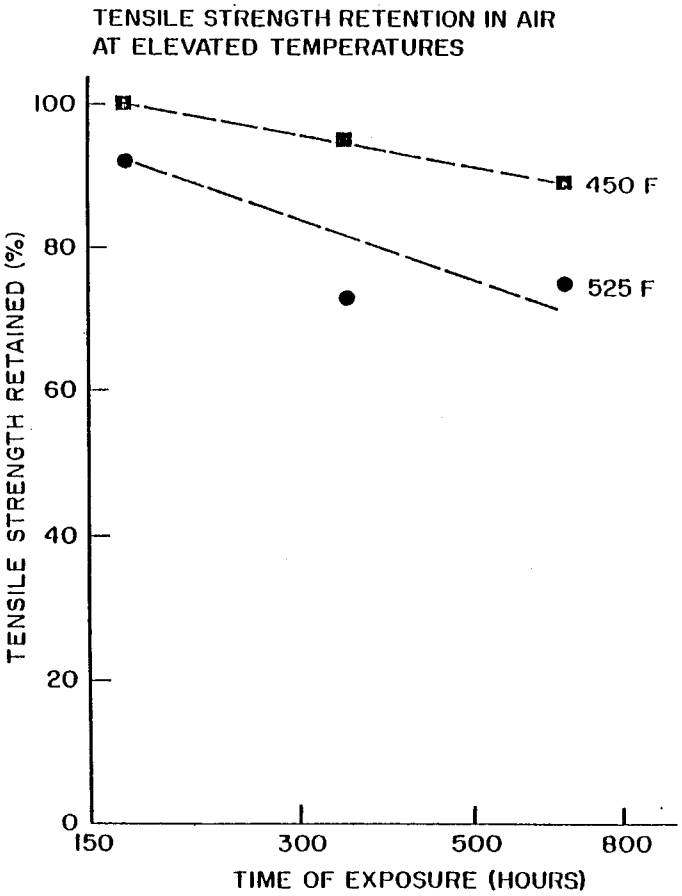
FIG. 3 is a chart showing the relationship between tensile strength retained and time of exposure of the Example 2 invention composite to elevated temperatures in air.
Figure 4:
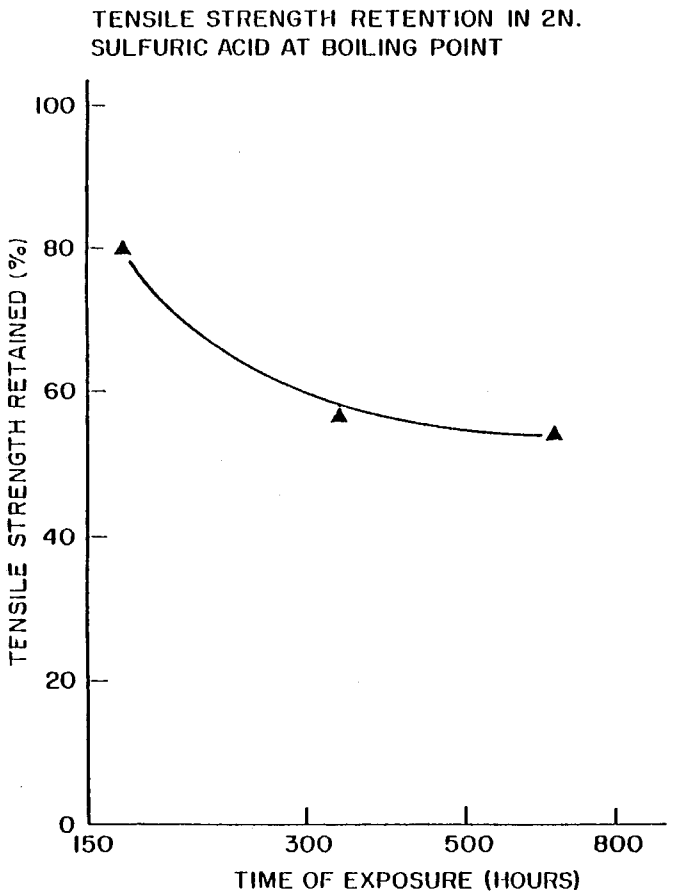
FIG. 4 is a chart showing the relationship between tensile strength retained and time of exposure of the Example 2 invention composite immersed in 2N sulfuric acid at its boiling point.

The invention and its advantages are also illustrated by the following examples. The examples illustrate composites employing a variety of substrates and coating matrices contemplated by the invention. The test procedures used for the chemical and physical testing and property determinations for the composites prepared according to the invention and the controls are identified below:

| PROPERTY | TEST PROCEDURE |
|---|---|
| Weight (oz/sq yd) | FED STD 191-5041 |
| Thickness (ins) | FED STD 191-5030 |
| Tensile Strength (lbs/in) | FED STD 191-5102 |
| Warp | |
| Fill | |
| Tensile after fold (lbs/in) (or Flex Fold) | BIRDAIR LP-78* |
| Warp | |
| Fill | |
| Trapezoidal Tear (lbs) | FED STD 191-5136 |
| Warp | |
| Fill | |
| Coating Adhesion (lbs/in) | BIRDAIR LP-62** |
| Dry | |
| Wet | |
| Back Elongation (%) | BIRDAIR LP-59*** |
| Warp | |
| Fill | |
| Flexural Rigidity (mg · cm) | ASTM D-1388 |
| Dielectric Strength (volts) | ASTM D-902 |
| Porosity, SCF per hour per sq. ft. at 9 in H2O pressure | ASTM D-737 |
| Hot Air Exposure, Hot Acid Exposure (%) | **** |

*This is a comparative flex-fold test whereby a rectangular test specimen (long dimension parallel to warp yarns in the "warp test" and parallel to filling yarns in "fill test") is folded at its center, rolled with a weighted roller, ten times, and tested as per G.S.A. 171 #5102. The test values are compared with tensile values for an unfolded specimen. Fold resistance is reported as percent of strength retained after the fold. (In the examples which follow, the results are expressed in actual tensile strength after folding, and the percent retention is not calculated.)

**This test measures the adherance of the coating matrix to a substrate by subjecting a specimen (prepared from two pieces of the sample composite joined face to face as in making a production type joint or seam) to an Instron Tester, Model 1130, whereby the pieces forming the specimen are separated for a specified length (3") at a specified rate of strain (2"/min.). The average reading during separation is deemed the adhesion value in lbs./in.

***This test relates to elongation or stretch characteristics under the continuous static loads experienced in actual applications. A cut rectangle (long dimension parallel to warp yarns for "warp" tests and parallel to filling yarns for "fill" tests) is attached to a rack and a 6 oz. weight at either end. A predetermined distance (10 inch) is marked off on the specimen and the 6 oz. weight is replaced with a specified load. After one minute, the change in distance between the "10 inch" marks is recorded. The same measurement is repeated at 1, 2, 4, 12 and 24 hour intervals to provide data for a plot of stretch vs. time. "Initial Stretch" is defined as percent increase in length. Stretch is calculated using a scale graduated in 10ths and 100ths of an inch, each .1" increase over 10" gage marks equals 1% stretch.

****These tests measure the tensile strength retained by materials exposed to hot air or hot sulfuric acid for various lengths of time. A number of cut rectangles are suspended in the indicated environments. At the stated intervals, specimens are removed and tensile strength measured. The results are reported as percent tensile strength retained after exposure.

EXAMPLE 1

In accordance with a preferred embodiment of this invention, an 18 oz. per sq. yd. fiberglass substrate, Chemfab style no. 15227, was heat cleaned to remove residual sizing. A combination of PTFE (TE-3313 obtained from DuPont as an aqueous dispersion, 60% solids,) and methylphenyl silicone oil (ET-4327 obtained from Dow Corning as an aqueous emulsion, 35% solids,) was then applied to the surface of the substrate by dipping, drying and fusing in a two zone coating tower with drying zone temperatures of approximately 200°-350° F. and a baking or sintering zone temperature of 700° F. The coating contained 93 parts PTFE, 7 parts methylphenyl silicone. The combination was applied as a very light undercoat, 5 oz./sq. yd., to avoid undesired stiffness. Only the yarns in the substrate were coated, the windows remaining substantially open.

A second coating, totaling approximately 20 oz/yd.$^2$, was applied from a blend of VITON B fluoroelastomer (VTR-5307 obtained from DuPont as a terpolymer latex, 60-65% solids) and PTFE (TE-3313). The coating was applied in several passes, by dipping, drying, and baking in a two zone tower with drying temperatures of 200°-350° F. and a baking zone temperature of only 500° F. The blend, designated FMK-4-10-B, comprised 60 percent PTFE and 40 percent terpolymer fluoroelastomer, by weight.

The material was completed by calendering the coated fabric with a 300° F. calender followed by a final dry pass through the coating tower to fuse or sinter the coating, with the baking zone at 700° F.

EXAMPLE 2

In accordance with the procedure of Example 1, a composite was prepared on a heat cleaned glass cloth substrate (Chemfab Style No. 122, 32 oz/sq. yd) using the same primer coat composition to a weight of 40-41 oz/sq. yd. and the same blend to a weight of 54-56 oz/sq. yd. In addition, a topcoat of PTFE was applied in several passes through TE-3313, to bring the total composite weight to approximately 60-62 oz./sq. yd. In this example the PTFE topcoat was applied following the application of the blend, which was not calendered beforehand, by dipping, drying, and baking at 590° F. The resulting material was calendered and processed through the tower, dry, with baking zone at 700° F. to sinter or fuse the coating. The so-called dry-fused composite was given a final coat of PTFE by dipping in TE-3313, drying, and fusing at 700° F. The composite was 0.046" thick, had tensiles in lbs./in. of 1400/1375 warp to fill, flex-fold in lbs./in. of 1400/1356 warp to fill, and tear strength in lbs. of 231/295 warp and fill. The coating adhesion was measured at 23 lbs./in. and the porosity was 0.013 SCF/hr./ft.$^2$ Four additional composites were manufactured in accordance with the method of Example 2, using glass cloth reinforcements of lighter weights and proportionately lighter builds of the various matrix components, as illustrated in the following table:

| | Ex. 2A | Ex. 2B | Ex. 2C | Ex. 2D |
|---|---|---|---|---|
| Reinforcement Style No. | 15227 | 128 | 116 | 1080 |
| Reinforcement Weight* | 18 | 6.1 | 3.2 | 1.45 |
| Undercoat Weight | 5 | 1.5 | 1.0 | 2.5 |
| Blend Coat Weight | 11 | 4.5 | 3.3 | 1.8 |
| PTFE topcoat Weight | 9 | 1.0 | 0.5 | 1.4 |
| Total Weight | 43 | 13.1 | 8.0 | 6.8 |

*All weights in oz./sq. yd.

These composites were tested as indicated in Table I below:

TABLE I

| | Ex. 1 | Ex. 2 | Ex. 2A | Ex. 2B | Ex. 2C | Ex. 2D |
|---|---|---|---|---|---|---|
| Weight (oz/yd$^2$) | 46.8 | 60 | 42.1 | 13.1 | 8.0 | 6.2 |
| Thickness (ins) | .035 | .046 | .034 | .009 | .006 | .005 |
| Tensile (lbs/in) | | | | | | |
| Warp | 1055 | 1400 | 983 | 217 | 177 | 148 |
| Fill | 900 | 1375 | 935 | 186 | 164 | 133 |
| Flex-Fold (lbs/in) | | | | | | |
| Warp | 960 | 1400 | 944 | 213 | 183 | 95 |
| Fill | 645 | 1356 | 888 | 130 | 173 | 140 |
| Tear (lbs) | | | | | | |
| Warp | 106 | 231 | 105 | 16.0 | 10.0 | 7.5 |
| Fill | 116 | 295 | 128 | 16.2 | 10.0 | 6.5 |
| Coating Adhesion Dry | 16.5 | 23 | 21.6 | 3.9 | 5.12 | 3.8 |
| Rack Elongation At 60 lb/in (%) Warp Tensile Stress | Not Tested | 2.0 | 2.2 | | Not Tested | |
| Rack Elongation At 60 lb/in (%) Fill Tensile Stress | Not Tested | 5.5 | 7.8 | | Not Tested | |
| Flexural Rigidity (mg cm) Warp | Not Tested | 193,000 | 110,000 | | Not Tested | |
| Porosity (SCF/hr/ft$_2$) | 0.00 | 0.013 | 0.008 | | Not Tested | |

Additionally, Example 2A was tested after 9 months service in an expansion joint at an electrical power generating station. The material in service showed considerably less degradation than conventional joints based on fluoro-elastomer.

EXAMPLES 3-8

Six additional composites were manufactured in accordance with the method of Examples 1 and 2, except that the ratio of the fluoroelastomer/PTFE blend was varied as follows:

TABLE II

| | Ex. 3 | Ex. 4 | Ex. 5 | Ex. 6 | Ex. 7 | Ex. 8 |
|---|---|---|---|---|---|---|
| VTR-5307 (Formula Wt.*) | 16 | 40 | 53 | 64 | 96 | 120 |
| TE-3313 (Formula Wt.*) | 150 | 125 | 117 | 100 | 67 | 42 |
| VTR-5307 (Component Wt.**) | 10 | 25 | 33 | 40 | 60 | 75 |
| TE-3313 (Component Wt.**) | 90 | 75 | 67 | 60 | 40 | 25 |

*Parts by weight of ingredient used, in concentration supplied by manufacturers.
**Parts by weight of component supplied by ingredient.

These compositions were tested as indicated in Table III below:

TABLE III

| Property | Units | Ex. 3 | Ex. 4 | Ex. 5 | Ex. 6 | Ex. 7 | Ex. 8 |
|---|---|---|---|---|---|---|---|
| Blend Ratio | wt. % elas./ wt. % PTFE | 10/90 | 25/75 | 33/67 | 40/60 | 60/40 | 75/25 |
| Weight | oz/yd.$^2$ | 46.9 | 44.4 | 45.0 | 44.9 | 43.9 | 43.4 |
| Thickness | in. | .038 | .036 | .037 | .036 | .036 | .035 |
| Tensile strength | | | | | | | |
| warp | lbs./in. | 1200 | 1205 | 1087 | 1190 | 1010 | 1055 |
| fill | | 395 | 745 | 562 | 645 | 700 | 675 |
| Tear strength | | | | | | | |
| warp | lbs. | 113 | 120 | 118 | 132 | 109 | 118 |
| fill | | 86 | 147 | 142 | 147 | 106 | 119 |
| Flex-fold strength | | | | | | | |
| warp | lbs/in | 945 | 840 | not | 1095 | 990 | 960 |
| fill | | 450 | 730 | run | 710 | 755 | 715 |
| Coating Adhesion | lbs./in. | 17.3 | 16.5 | 17.0 | 18.3 | 19.3 | 15.5 |
| Dielectric strength (2 in. electrode) | volts | 5500 | 5300 | 4700 | 5200 | 5500 | 4500 |
| Porosity at 9" water pressure | SCF/hr/ft.$^2$ | .000 | .011 | .000 | .011 | .000 | .067 |
| Flexural rigidity | mg · cm | 135900 | 122200 | 112300 | 112000 | 99300 | 61500 |

Preparation of Controls

A control A composite was prepared using Chemfab style 15227 glass cloth (18 oz./yd.$^2$) which was heat cleaned to remove residual sizings. This substrate was then coated to 41 oz./sq. yd. with a blend of (a) a fluoroelastomer (L-6517 obtained from 3M and being a copolymer latex, 55% solids), and (b) PTFE (Teflon 30B from DuPont) in an 80/20 (PTFE/fluoroelastomer) ratio, by weight. The coating was applied in several passes at processing temperatures of 400° F. Control B is simply a portion of Control A baked under dry fuse conditions as are the invention composites. Control C is, in turn, a portion of Control B having a fused top coat of PTFE (TE-3313) in an amount of approximately 1.25 oz./sq. yd.

The results of physical tests of these contents are set forth below in Table IV

TABLE IV

| Property | Units | Control A | Control B | Control C |
|---|---|---|---|---|
| (number of high temperature bake passes) | | (none) | (1) | (2) |
| Weight | oz/yd$^2$ | 41.0 | 41.0 | 41.4 |
| Thickness | in. | .030 | .032 | .032 |
| Tensile strength | | | | |
| warp | lbs/in. | 935 | 843 | 753 |
| fill | | 818 | 660 | 750 |
| Tear strength | | | | |
| warp | lbs. | 131 | 97 | 94 |
| fill | | 130 | 91 | 89 |
| Coating Adhesion | lbs/in. | 1.0* | 1.0* | 1.0* |

*very poor seal: coating is squeezed out of joint

EXAMPLES 9 A-C

A comparison was made using samples of the composites prepared in accordance with Examples 1 and 2, but using different commercially available fluoroelastomers. The first composite, 9A, was prepared essentially as was the composite of Example 6. Composite 9B was made in essentially the same manner, but substituting the L-6517 fluoroelastomer (a 3M copolymer latex, 55% solids). Similarly, composite 9C was prepared by substituting yet another 3M fluoroelastomer (L-6546, a terpolymer latex containing 60% solids) for the DuPont VTR 5307.

The results of the physical tests conducted with these composites are reported in Table V below:

TABLE V

| PROPERTIES | Examples 9A | 9B | 9C |
|---|---|---|---|
| Weight (oz/yd) | 44.5 | 44.4 | 45.0 |
| Thickness (ins) | .037 | .037 | .036 |
| Tensile (lbs./in.) | | | |
| comp | 1190 | 1236 | 1267 |
| fill | 590 | 803 | 927 |
| Flex Fold (lbs./in.) | | | |
| comp | 940 | 870 | 880 |
| fill | 605 | 975 | 835 |
| Tear (lbs) | | | |
| comp | 129 | 109 | 133 |
| fill | 117 | 149 | 141 |
| Porosity (SCF/hr./ft$^2$) | .000 | .000 | .000 |
| Coating Adhesion (lbs/in.) | 18.2 | 15.2 | 13.3 |

EXAMPLE 10 A-C

Composite 10A was prepared using Style 15227 glass cloth (18 oz./sq. yd.) which was first heat cleaned to remove residual sizings. A combination of PTFE (TE3313) and methyl phenyl silicone oil (Dow Corning) was then applied to the substrate surface in an amount of 5 oz./sq. yd. A second coating of a blend of 3M fluoroelastomer (L-6517) and FEP resin (DuPont TE-9503 aqueous dispersion, 55% solids) in a 40/60 ratio was then applied in several passes in an amount of 8 oz./sq. yd. The composite was finished with a topcoat of PTFE (TE-3313) in an amount of 5 oz./sq. yd. to yield a composite weight of 36 oz./sq. yd. A second composite 10B was prepared by substituting a 40/60 blend of 3M L-6546 fluoroelastomer and DuPont TE-9503, and a third composite 10C was similarly prepared using a 40/60 blend of DuPont VTR5307 and TE-9503.

The results of physical tests with these composites is set forth in Table VI below:

TABLE VI

| Property | Samples 10A | 10B | 10C |
|---|---|---|---|
| Weight (oz/yd$^2$) | 36.1 | 36.9 | 37.6 |
| Thickness (ins) | .034 | .036 | .034 |
| Tensile (lbs./in.) | | | |
| Warp | 1028 | 1126 | 882 |

TABLE VI-continued

| Property | Samples 10A | 10B | 10C |
|---|---|---|---|
| Fill | 522 | 590 | 360 |
| Flex-Fold (lbs./in.) | | | |
| Warp | 709 | 765 | 823 |
| Fill | 578 | 620 | 343 |
| Tear (lbs.) | | | |
| Warp | 108 | 110 | 95 |
| Fill | 94 | 137 | 67 |
| Coating Adhesion | | | |
| Dry | 8.3 | 5.1 | 6.3 |
| Wet | | | |
| Porosity (SCF/hr./ft$^2$) | .084 | .033 | .134 |
| Flexural Rigidity (mg · cm) | 85,700 | 132,600 | not run |

EXAMPLE 11 A–C

Composites using reinforcements other than glass were prepared as indicated in Table VII. Composites 11A, 11B, and 11C were made in accordance with the method employed in the Example 2, using a three component matrix consisting of the PTFE-silicone oil primer, the intermediate blend component, and the PTFE topcoat.

TABLE VII

| | Ex. 11A | Ex. 11B | Ex. 11C |
|---|---|---|---|
| Reinforcement Material | aramid Kevlar | aramid Nomex | graphite |
| Weaver | Chemfab | Chemfab | Fiberite |
| Style No. | 100-20 | 100-10TCN | W-134 |
| Reinforcement Weight* | 6.6 | 2.8 | 5.8 |
| PTFE-silicone oil primer weight | 2.5 | 4.3 | 2.6 |
| Blend weight | 7.5 | 9.1 | 6.3 |
| PTFE topcoat weight | 1.4 | 2.0 | 0.9 |
| Total weight | 18.0 | 18.2 | 15.6 |

*all weights in oz/yd$^2$

The composites prepared in accordance with Example 11 were tested as indicated in Table VIII below.

TABLE VIII

| EXAMPLE | 11A | 11B | 11C |
|---|---|---|---|
| Weight (oz/yd$^2$) | 17.8 | 18.8 | 15.4 |
| Thickness (ins) | .019 | .020 | .015 |
| Tensile strength (lbs/in) | | | |
| Warp | 661 | 73 | 403 |
| Fill | 815 | 65 | 403 |
| Flex-Fold strength (lbs/in) | | | |
| Warp | 639 | 79 | 118 |
| Fill | 825 | 76 | 315 |
| Tear strength (lbs) | | | |
| Warp | 84 | 5.3 | 40 |
| Fill | 84 | 9.0 | 50 |

TABLE VIII-continued

| EXAMPLE | 11A | 11B | 11C |
|---|---|---|---|
| Coating Adhesion Dry | 10.3 | 18.0 | 11.0 |

Hot Air and Hot Acid Exposure Test Results
Tensile Strength (warp) Retained after Exposure (%)

| | 2N. sulfuric acid at b.p. | | | air at 450° F. | | | air at 525° F. | | |
|---|---|---|---|---|---|---|---|---|---|
| | 1 wk | 2 wk | 4 wk | 1 wk | 2 wk | 4 wk | 1 wk | 2 wk | 4 wk |
| Ex. | | | | | | | | | |
| 1 | 69 | 57 | nc* | 95 | 99 | nc | 95 | 91 | nc |
| 2 | 80 | 57 | 54 | 100 | 95 | 89 | 92 | 72 | 75 |
| 2A | 77 | 66 | 52 | 96 | 81 | 98 | 73 | 84 | 81 |
| 3 | 94 | 46 | nc | 100 | 98 | nc | 100 | 82 | nc |
| 4 | 98 | 46 | nc | 98 | 86 | nc | 95 | 84 | nc |
| 5 | 63 | 53 | nc | 99 | 100 | nc | 93 | 94 | nc |
| 6 | 100 | 56 | nc | 91 | 94 | nc | 95 | 86 | nc |
| 7 | 100 | 59 | nc | 96 | 100 | nc | 97 | 95 | nc |
| 8 | 94 | 48 | nc | 100 | 98 | nc | 99 | 92 | nc |
| 4A | 32 | 26 | nc | 88 | 84 | nc | 77 | 68 | nc |
| 4B | 61 | 35 | nc | 93 | 90 | nc | 94 | 79 | nc |
| 4C | 56 | 25 | nc | 81 | 82 | nc | 73 | 69 | nc |
| 9A | 74 | 56 | 46 | 100 | 94 | 90 | 91 | 79 | 80 |
| 9B | 66 | 45 | 45 | 95 | 95 | 99 | 86 | 59 | 73 |
| 9C | 55 | 33 | 41 | 91 | 91 | 95 | 84 | 59 | 67 |
| 10A | 76 | 49 | 54 | 100 | 100 | 100 | 100 | 69 | 100 |
| 10B | 73 | 53 | 51 | 100 | 88 | 100 | 96 | 82 | 90 |
| 10C | 93 | 63 | 59 | 100 | 93 | 100 | 96 | 83 | 96 |

*Test not complete as of date of filing

EXAMPLES 12 A–D

Four additional composites were manufactured in accordance with the method of Examples 1 and 2, however the lubricant/saturant was either (1) ET-4327 methyl-phenyl silicone oil emulsion applied in FMK-4-10-A (CHEMFAB internal designation for mixture of TE-3313 (DuPont) and ET-4327 (Dow Corning Corp.) containing approximately 93 percent by weight PTFE and 7 percent by weight silicone oil diluted with water to a specific gravity of 1.32); (2) ET-4327 methyl-phenyl silicone in an aqueous solution (mixture of 1 part by volume ET-4327 methyl-phenyl silicone oil emulsion, manufactured by Dow Corning, and 8 parts by volume tap water); (3) ET-4327 methyl-phenyl silicone in an aqueous solution, 1 part by volume: 4 parts by volume tap water; or (4) a mixture of 9 pbw ET-4327 diluted with tap water, 1:8 by volume) and 1 pbw AQUADAG E colloidal graphite dispersion. With the exception of the material having the FMK-4-10-A initial fuse dip, a second fuse dip of TE-3313 (1.35 specific gravity) was applied following the application of the lubricant. The four compositions were then completed in accordance with the procedures of Examples 1 and 2.

The resulting materials were tested for weight; thickness; tensile, tear, and flex fold strength and coating adhesion; and MIT flex endurance. The results are shown in Table IX as follows:

TABLE IX

| | 12A | 12B | 12C | 12D |
|---|---|---|---|---|
| Lubricant/saturant | | | | |
| Composition | Silicone | Silicone | Silicone | Silicone-graphite |
| Applied from | FMK4-10A | 1:8 sol. | 1:4 sol. | 9 pbw 2 ½:5 sol. 1 pbw Aquadag E |
| Pick-up (oz/yd$^2$) | .4(1) | .3(2) | .7(2) | .4(3) |
| Weight (oz/yd$^2$) | 43 | 42 | 42 | 43 |
| Thickness (in.) | .035 | .035 | .035 | .034 |
| Tensile (lbs/in.) | | | | |
| strength | 1095 | 1113 | 1060 | 1070 |

TABLE IX-continued

| | 12A | 12B | 12C | 12D |
|---|---|---|---|---|
| fill | 970 | 907 | 910 | 1010 |
| Tear (lbs.) | | | | |
| strength | 120 | 123 | 121 | 139 |
| fill | 119 | 132 | 135 | 159 |
| Flex-fold (lbs/in.)(4) | | | | |
| strength | 715 | 920 | 930 | 985 |
| fill | 780 | 880 | 840 | 935 |
| Coating adhesion (lbs/in.) | 20 | 16 | 16 | 19 |
| MIT Flex(5) (folds to failure × $10^3$) | | | | |
| warp | 49 | 35 | 66 | 87 |
| fill | 44 | 44 | 54 | 83 |

NOTES:
(1)Calculated value based on 7% FMK4-10A pick-up.
(2)Experimentally determined values.
(3)Measured on actual run.
(4)Rolled on 10X with 10 lb. roller.
(5)MIT Folding Endurance Tester, 0.04 in. jaws, 5 lb. weight, No. 10 spring.

EXAMPLE 13

Composites using TE-5489 (low crystallinity, compliant, perfluorinated TFE copolymer obtained from DuPont) resin dispersion were prepared as follows. In Example 13, Chemfab Style 116 glass was heat cleaned and given four fuse dips through the full strength TE-5489 (33% solids, 1.23 specific gravity, 9.5 cps). The 3.04 oz/yd$^2$ heat cleaned substrate picked up a total build of approximately 0.7 oz/yd$^2$. Microscopic examination of the product revealed a resiliant, uncracked and generally flaw-free coating encapsulating the yarns and well adhered to them.

EXAMPLE 14

Example 14 was prepared by pouring 25 grams of TE-5489 on a 3×5 inch piece of heat cleaned and silicone treated 15227 glass cloth in a tray. The water was dried away in an air circulating oven at 75° C. and the resulting fabric, saturated with the dried polymer, was molded in a 0.040 inch thick chase at approximately 400° F. for ten minutes in a platen press. The resulting composite was extremely flexible and compliant, and the coating was strong and resiliant and was resistant to scratching.

EXAMPLES 15 A–C

Examples 15A and 15B were prepared as follows. Following heat cleaning, two lengths of Chemfab Style 129 glass cloth (6.2 oz/yd$^2$) (ECD 225 1/3, 38×40) were coated in multiple semifused dip passes through 50:50 (weight) blends of TE-5489 and commercially available perfluorinated resin dispersions (as described below), followed by final dry fuse passes. Example 15A received 7 passes through such a blend made with TE-3313 which resulted in a 9.54 oz/yd$^2$ composite. Example 15B received 6 passes through a blend made with TE-9503 thermally concentrated in the laboratory to 63% solids, and resulted in a 9.25 oz/yd$^2$ product. These examples were tested as shown below.

TABLE XI

| Property | Units | 15A | 15B |
|---|---|---|---|
| Weight | oz/yd | 9.5 | 9.3 |
| Thickness | in. | .009 | .009 |
| Dielectric strength | | | |
| ¼" elec. | volts | 1700 | 1700 |
| 2" elec. | | 1300 | 1300 |
| Strip Tensile strength | | | |
| warp | lbs/in | 308 | 325 |
| fill | | 315 | 348 |
| Trap. tear strength | | | |
| warp | lbs | 20 | 22 |
| fill | | 26 | 22 |
| Coating adhesion | lbs/in. | 7.1 | 4.4 |

Example 15C was prepared as follows. Following heat cleaning, Chemfab Style 15227 glass cloth (18 oz/yd$^2$) (ECB 150 4/3, 18×19) was treated with silicone oil by dipping the cloth in ET-4327 diluted 1:8 by volume with water, followed by drying and baking at 650° F. An initial coat of 50:50 (weight) blend of TE-3313 and TE-5489 was then applied by dipping, wiping with smooth bars, drying, and baking at 500° F. This initial coat weighed 5.1 oz/yd$^2$. An overcoat of FMK-4-10-B was then applied in five successive semifuse passes totaling 17.7 oz/yd$^2$. A top coat of 1 oz/yd$^2$ of PTFE was applied in a single, unwiped semifused pass through TE3313 at 1.30 specific gravity. The material was then calendered and finally completed by fusing in a single dry fuse pass at 720° F.

The finished composite was softer than Examples 1 and 2. The coating, although not as glossy and feeling more compressible than the coatings of Examples 1 and 2, otherwise was as durable when the material was subjected to rough handling such as scraping and creasing. The warp tensile strength of this material was 863 lbs/in.; the coating adhesion strength was 8.9 lbs/in.

EXAMPLES 16 A–F

Example 16A was prepared by giving Chemfab Style 100–20 woven KEVLAR fabric (approximately 16×16 count, approximately 6.6 oz/yd$^2$, yarn construction unknown) 2 wiped fuse dips through undiluted TE-5489 dispersion. Sintering zone temperatures were 550° F. during both passes. The finished weight of the fabric was 8.9 oz/yd$^2$.

Example 16B was made with the same reinforcement as Example 16A and was given a single fuse dip through TE-5489 under the same conditions as the initial operation on Example 16A, bringing its total weight to 7.90 oz/yd$^2$. This was followed by three semifuse dips, wiped, through FMK-4-10-B, with baking zone at 500° F., which raised the total weight, in succession, to 11.4, 13.5, and 17.0 oz/yd$^2$, respectively. The material was completed with a fuse pass at 700° F.

Example 16C was also made with the same reinforcement as Examples 16A and 16B, but in Example 16C the initial coat consisted of a blend of 50% by weight PTFE from TE-3313 and 50% by weight polymer from TE-5489, applied as a wiped fuse dip at 550° F. The total weight of the reinforcement and the initial coat thus applied was 8.4 oz/yd$^2$. As an overcoat, 3 dips of FMK-4-10-B were applied and dry fused essentially as they were in making Example 16B, yielding a finished product weighing 16.8 oz/yd$^2$. The three products were tested as shown in the following table.

TABLE XII

| Property | Units | 16A | 16B | 16C |
|---|---|---|---|---|
| Weight | oz/yd$^2$ | 8.7 | 17.0 | 16.5 |
| Thickness | in. | .017 | .019 | .019 |
| Trap. tear strength | | | | |
| warp | lbs. | NR* | 88 | 70 |
| fill | | NR* | NR | 74 |
| Strip Tensile strength | | | | |
| warp | lbs/in. | 435 | 600 | 631 |
| fill | | 581 | 640 | 827 |
| Coating adhesion | lbs/in. | 4.8 | 7.2 | 10.0 |

*NR — no reading (yarns bunched)

A reinforcement for Examples 16D, E and F was made by heat cleaning Style No. W-134 woven graphite fabric (5.8 oz/yd$^2$, approximately 12×12 count manufactured by Fiberite Corporation) by baking at 680° F. Example 16D was then made by giving the reinforcement two wiped fuse dips through TE-5489 dispersion at 550° F. The finished weight was 8.3 oz/yd$^2$.

In making the composition of Example 16E, the heat cleaned graphite was given a silicone treatment by dipping the unwiped reinforcement through ET-4327, diluted 1:8 by volume with water, followed by drying and baking at 500° F. This was followed by a wiped fuse dip through TE-5489 and baking at 550° F. bringing the 6.0 oz/yd$^2$ silicone treated fabric to a total weight of 7.4 oz/yd$^2$. Three additional wiped, semifused dips of FMK-4-10-B were applied and followed by baking at 500° F. bringing the weight to 11.9, 13.6, and 15.7 oz-/yd$^2$, respectively, after each pass. A final bake was accomplished at 700° F.

Example 16F was made according to essentially the same procedure as Example 16E, using the silicone treated reinforcement, but with the 50:50 solids blend of TE-3313 and TE-5489 replacing the TE-5489 as the initial coat. The weight following this step was 7.8 oz-/yd$^2$. Three wiped, semifused dips of FMK-4-10-B were subsequently applied and dry fused as they were in making Example 16E, resulting in a finished weight of 15.5 oz/yd$^2$. The three products were tested as shown in the following table.

TABLE XIII

| Property | Units | 16D | 16E | 16F |
|---|---|---|---|---|
| Weight | oz/yd$^2$ | 8.4 | 16.5 | 15.5 |
| Thickness | in. | .014 | .017 | .017 |
| Strip Tensile strength | | | | |
| warp | lbs/in. | 363 | 443 | 360 |
| fill | | 330 | 435 | 343 |
| Trap. tear strength | | | | |
| warp | lbs. | 27 | 15 | 9.5 |
| fill | | 17 | 20 | 4.0 |
| Coating adhesion | lbs/in. | 6.6 | 8.0 | 11.4 |

EXAMPLES 17 A–M

Several examples incorporating a KALREZ latex obtained from DuPont and identified as 34045-133 were prepared by a laminating process which involved evaporating the dispersion to dryness to obtain a crumb, pressing the crumb to a film in a platen press and laminating the film to a substrate, also in a platen press. Example 17A was prepared by heat cleaning Style 15227 glass and giving the glass a silicone treatment by dipping through ET-4327 diluted 1:8 by volume with water followed by drying and baking. The treated substrate was then dipped through the KALREZ dispersion, unwiped, and baked at 500° F. The resulting composite weighed 20.8 oz/yd$^2$.

Example 17B was prepared by giving a portion of the coated fabric of Example 17A four semifused passes through TE-3313, viscosified to approximately 150 cps while wiping with 40 mil wire wound bars. The resulting 36.2 oz/ yd$^2$ material was pressed in a platen press for 1 minute at approximately 1,300 psi with platens heated to 325° F. The coated surfaces were protected by release sheets of CHEMFAB 100-10 TCGF (PTFE coated glass fabric) during the pressing. The material was then baked for 20 minutes in an air circulating oven at 525° F. to remove residual surfactant. It was returned to the press, protected by clean aluminum foil on both sides, and sintered by pressing at minimum pressure (less than 15 psi), with platens heated to 720° F., for 5 minutes. The resulting material weighed approximately 35.5 oz/yd$^2$.

Example 17C was prepared by giving a portion of the coated fabric of Example 17A five wiped passes through undiluted VTR-5307 fluoroelastomer latex. Each pass was dried and baked at approximately 300°–450° F. The material was then baked in a 525° F. air circulating oven for 20 min. to remove residual surfactant. The final weight was 32.2 oz/yd$^2$.

Example 17D was prepared by giving a portion of coated fabric of Example 17A three semifuse passes wiped with 40 mil wire wound bars, through FMK-4-10-B, all passes at 10 in/min. The material, which at this point weighed 32.9 oz/yd$^2$, was subsequently baked 20 minutes in a 525° F. air circulating oven and fused in a platen press at less than 15 psi with 720° F. platens for 5 minutes between sheets of clean aluminum foil.

In Example 17E, a KALREZ crumb was prepared by evaporating a quantity of KALREZ dispersion to dryness in an air circulating oven at 75°–85° C. Ten grams of the crumb were placed between an approximately 18×18 inch piece of aluminum foil treated with silicone mold release (SPRITS SILICONE MOLD RELEASE, sold by Sprits of Melville, N.Y.) on one side and a similar sized sheet of silicone resin coated glass fabric (available as SRC-5 from Oak Industries, Inc., Hoosick Falls, N.Y.) on the other. The material was placed between smooth caul plates of ⅛" stainless steel and pressed for 5 minutes at 80 tons force on the platens at 550° F., following which the work was cooled under pressure. The result was a circular piece of KALREZ film approximately 8–10" in diameter and varying in thickness from 0.005 to 0.008 in.

The film was then folded over an edge of a portion of Example 17A in such a way that approximately equal semicircular areas of film were opposite each other on opposite sides of the Example 17A coated reinforcement. This sandwich was placed in the press between thicknesses of glass cloth serving as compression pads to force the film into the irregularities of the reinforcement. Aluminum foil, treated with a silicone mold release, was used between the film and compression pads.

Stainless caul plates were used. The laminate was pressed for 5 minutes at 550° F. employing a force of 10 tons on the platens, (approximately 400–500 lbs/in$^2$ on the 10 in. diameter semicircular composite). The composite was cooled under pressure.

The foil was easily stripped away to obtain the resulting semicircular laminated composite surrounded by the more lightly coated reinforcement. This material was again placed in the press between mold-release-treated aluminum foil sheets for 5 minutes with 5 tons force on the platens at 350° F. to smooth out the fabric imprint which came through the foil from the compression pad. The completed smooth laminate was 0.028 to 0.029 inches thick near the center and 0.026 to 0.027 inches near the edges. Under the microscope, no voids were visible, either looking through the face of the fabric or at cut edges. Visually, it could not be distinguished from dip coated material except for its complete lack of bubbles, pin holes and craters.

Similar laminated composites were made by the same technique as Example 17E, using Examples 17D, 17C and 17B as substrates. These were designated Examples 17G, 17H, and 17J, respectively.

To facilitate comparisons, the compositions of Examples 17A–E and G, H and J are summarized in the following table.

TABLE XIV

| | Example No. | | | |
|---|---|---|---|---|
| | 17A | 17B | 17C | 17D |
| Reinforcement | 15227 | 15227 | 15227 | 15227 |
| 1st matrix comp. (dip coat) | ET-4327 | ET-4327 | ET-4327 | ET-4327 |
| 2nd matrix comp. (dip coat) | Kalrez | Kalrez | Kalrez | Kalrez |
| 3rd matrix comp. (dip coat) | — | TE-3313 | VTR-5307 | FMK-4-10-B blend |
| Weight (oz/yd$^2$) | 20.8 | 35.5 | 32.2 | 32.9 |

(portions of the above materials were in turn laminated to produce the following:)

| | Laminate Exp. No. | | | |
|---|---|---|---|---|
| | 17E | 17J | 17H | 17G |
| Laminated matrix comp. | Kalrez | Kalrez | Kalrez | Kalrez |
| Thickness (in.) | .027–.030 | .037–.041 | .030–.034 | .033–.035 |

Example 17K was prepared by placing a film made from KALREZ latex as described in the procedure for preparing Example 17E on one side of a piece of Chemfab Style 129 glass fabric which had been previously heat cleaned. The layup was protected on both sides by aluminum foil and placed in a platen press and pressed for one minute at 550° F. using minimum obtainable force. The material which was removed from the press was a one-sided composite with the film well adhered to the reinforcement. A piece of the one-sided composite was coated on the bare glass side with contact adhesive (Armstrong "N-111 INDUSTRIAL ADHESIVE"). The same adhesive was also applied to one side of a swatch of polyester-cotton fabric. After drying, the two adhesive-coated materials were pressed together to form a two-ply fabric having one perfluoroelastomer face and one polyester-cotton face, such as would be suitable for a garment.

Example 17L was a graphite reinforced perfluoropolymer composite which was prepared by using the Example 16D material as a substrate and making a laminate according to the techniques employed in producing Example 17E. As heretofore noted, the initial coating on the substrate was derived from TE-5489, a low crystallinity perfluoropolymer based dispersions. The resulting laminate was approximately 0.015 inches thick with a smooth, resiliant matrix which appeared to thoroughly saturate the reinforcement.

Example 17M was a laminate prepared by bonding 0.005 inch thick PTFE skived film (available from Chemplast, Inc., Wayne, New Jersey) to both faces of a substrate of Example 17D, which in turn consisted of 15227 reinforcement, silicone treated with an initial coat of KALREZ followed by an overcoat of blended fluoroelastomer-PTFE (FMK4-10B). The laminate was pressed under the following conditions: platen temperature, 720° F.; pressure, 10 tons force on a specimen measuring approximately 5 in.×10 in.; time at temperature, 5 minutes; cooled under pressure to 500° F.; and removed from press. The completed specimen was 0.035 to 0.037 inches thick. The PTFE appeared to be strongly adhered to the overcoat. There was no tendency toward separation even after repeated splitting off of small areas of the laminated overcoat and attempting to pull the layers apart.

EXAMPLES 19 A&B

Example 19A was prepared as follows: Chemfab Style 122 glass fabric was heat cleaned. A silicone oil lubricant/saturant and an initial coat of PTFE were then applied simultaneously in a single dip through a bath of FMK 4–10A followed by drying and baking. The prepared reinforcement was laminated between 0.012 inch sheets of uncured calendered sheet stock identified as "Fluorel based Diak catalyzed fluoroelastomer compound suitable for flue duct applications" (Passaic Rubber Corporation, Clifton, N.J.) The rubber was brushed with acetone on the sides contacting the fabric before the material was laid-up and the sandwich was cured by pressing for 15 minutes between 350° F. platens at approximately 250 to 300 lbs/in.$^2$ (on specimen) and cooling under pressure to 200° F. The resulting reinforced rubber slab was approximately 0.14 inches thick and was very flexible with a good integrity.

Example 19B was prepared according to the same procedures as those employed in the preparation of Example 19A except that the substrate used was 15227 as the reinforcement and the rubber slabs were not brushed with acetone prior to lay-up. The resulting material was also 0.04 inches thick, appeared to be equally flexible when compared with Example 19A, and also possessed good integrity.

EXAMPLES 20 A&B

A KALREZ crumb containing 1.5 parts per hundred parts rubber of Triallylisocyanurate (TAIC) (manufactured by Nippon Kasei Chemical Company, Ltd., Tokyo, Japan and available in the United States from Mitsubishi International Corporation, New York, N.Y.) was made by adding the necessary TAIC as a 5% solution in denatured ethanol to the KALREZ dispersion and evaporating the treated latex to dryness at about 90° C. The addition of TAIC in this manner did not appear to induce coagulation.

Two composites were made according to techniques identical with those used in preparing Examples 17E, G, H and J. One was made on Example 17A, designated Example 20A, and one was made on Example 16A, designated Example 20B. Each of these composites was irradiated with a 1 MeV electron beam to a total of 4, 8 and 16 megarads, respectively. The beam current employed was 5 milliamps. Determination of the dyanamic modulus for the irradiated composites suggests that the radiation had induced cross-linking.

EXAMPLE 21

Composites manufactured in accordance with the method of Example 2 were plied and laminated in a platen press, with 0.005 inch FEP film as a melt adhesive between plies, using the following laminating conditions:

platen temperature: 670° F.
pressure: approximately 500 psi
time at temperature: 6 min.

Four examples of 2 ply laminates were produced, differing in the relative orientation of the warp yarns in the plies. Examples were made with warp yarns parallel (0° skew), skewed 30°, skewed 45°, and perpendicular (90° skew).

Composites manufactured in accordance with Example 2A were also laminated, using pressing conditions similar to those described above, but with lower pressure, approximately 280 psi (45 tons force on 18 in.×18 in. laminate). Ply warp yarn orientations of 0, 30, 45, and 90 degrees were employed in making these examples also.

The laminates were tested for strip tensile and trapezoidal tear strength. The results of these tests are reported in Table XVI below.

TABLE XVI

Strip Tensile and Trapezoidal Tear Strength of 2 Ply Laminates

| Ply Construction | Warp Yarn Orientation (deg) | Strip Tensile Warp | (lbs/in)[1] Fill | Trapezoidal Tear Warp | (lbs/in) Fill |
|---|---|---|---|---|---|
| Example 2 | Single ply control | 1265 | 1141 | 185 | 203 |
| " | 0 | 1895[2] | 1775[2] | 415 | 503 |
| " | 30 | 1306 | 1400 | 507 | 706 |
| " | 45 | 1265 | 1243 | 541 | 731 |
| " | 90 | 1438 | 1511 | 518 | 485 |
| Example 2A | Single ply control | 833 | 869 | 87 | 101 |
| " | 0 | 1468 | 1437 | 134 | 150 |
| " | 30 | 828 | 855 | 163 | 285 |
| " | 45 | 858 | 815 | 149 | 208* |
| " | 90 | 827 | 853 | 165 | 207 |

Notes:
[1]Specimen width 2 inches; calculated breaking stress per inch of width shown in table
[2]Specimens slipped in jaws with highest clamping pressure

EXAMPLE 22

A knit fiberglass fabric weighing approximately 5 oz/yd$^2$ was given an unwiped dip through Dow Corning ET-4327, which had been diluted 1:8 by volume with tap water dried and baked. The treated knit substrate was then given a single dip through KALREZ dispersion; dried; and baked at 700° F. The coated reinforcement was placed between layers of a film prepared from Kalrez and the sandwich, protected by aluminum foil treated with a silicone mold release, was pressed between platens 550° F. at approximately 100 psi for 5 minutes and cooled under pressure. The resulting composite was soft and flexible.

EXAMPLE 23

In accordance with the method used in preparing Example 22, but with different laminating conditions (i.e., 720° F. platen temperature, approximately 500 psi pressure, 3 minutes at temperature followed by cooling under pressure), a laminate was made with a film of FMK-4-10-B reinforced with knitted fiberglass fabric which had been primed with ET-4327 and dip coated in a Kalrez latex.

EXAMPLES 24 A–D

A series of four specimens similar to Example 2A was produced comparing PFA, FEP, and PTFE as topcoats and PFA and PTFE as the resin constituent of the perfluoropolymer/fluoroelastomer blend overcoat. The construction of the composites is summarized in the following table.

| | Example No. | | | |
|---|---|---|---|---|
| | 24A | 24B | 24C | 24D |
| Reinforcement | 15227, Heat Cleaned | | | |
| Initial Layer | FMK-4-10-A | | | |
| Overcoat, layer 1 | FMK-4-10-B | FMK-4-10-B | TE-335/ VTR 5307 | FMK-4-10-B |
| Overcoat, layer 2 | TE-3313* | TE-3313* | TE-3313* | TE-3313* |
| Topcoat | TE-335 | TE-3313 | TE-3313 | TE-9503 |

NOTES:
FMK-4-10-B is 60/40 weight blend of TE-3313 and VTR 5307
TE-335 is PFA (perfluoroalkoxy modified PTFE) dispersion (Du Pont)
TE-3313 is a PTFE dispersion.
TE-9503 is FEP dispersion (Du Pont)
*Viscosified All materials were processed in a manner similar to Example 2A. The initial layer was applied in an unwiped fuse dip. The overcoat layers were applied in multiple, wiped, semifuse dips to bring total fabric weight to approximately 40 ox/yd. The fabrics were calendered to consolidate the semifused layers, dry fused, and completed with single unwiped fuse dips through the topcoat dispersions.

Samples of the materials were tested for initial physical properties with results shown below.

TABLE XVII

| Property | Units | 24A | 24B | 24C | 24D |
|---|---|---|---|---|---|
| Weight | oz/yd | 40.9 | 40.9 | 44.4 | 40.7 |
| Thickness | in. | .032 | .032 | .038 | .032 |
| Tensile | | | | | |
| warp | lbs/in | 967 | 933 | 860 | 940 |
| fill | | 853 | 875 | 720 | 730 |
| Tear | | | | | |
| warp | lbs. | 108 | 107 | 129 | 117 |
| fill | | 131 | 122 | 121 | 135 |

TABLE XVII-continued

| Property | Units | 24A | 24B | 24C | 24D |
|---|---|---|---|---|---|
| flex fold | | | | | |
| warp | lbs/in | 607 | 760 | 733 | 813 |
| fill | | 873 | 793 | 600 | 773 |
| Dielectric Strength, 2" elec. | volts | 3700 | 4000 | 3800 | 4000 |
| MIT Flex warp | folds to failure, $\times 10^{-3}$ | 34 | 37 | 33 | 46 |
| Coating Adhesion | lbs/in | 15.5 | 14.2 | 12.3 | 14.2 |

EXAMPLES 25 A–C

Pieces of copper foil, 0.003 inches thick, etched on one side (available from Yates Industries, Inc., Bordentown, N.J.; specify type "A" etch) were washed with soap and water, rinsed with distilled water, washed with reagent grade acetone, and air dried. The etched surface was treated with gamma-Aminopropyltriethoxysilane (available from Union Carbide Corporation, New York, N.Y. as A-1100) by dipping in a 1% aqueous solution and drying in an air circulating oven at 225° F. Laminates were made on the treated foil substrate as shown in the following table:

| | 25A | 25B | 25C |
|---|---|---|---|
| Initial coat layer | .005" FEP film* | TE-5489 film* (from solids) | FMK-4-10-B film* (from solids) |
| Overcoat layer | FMK-4-10-B film | no overcoat | no overcoat |
| Platen temperature (°F.) | | 550 | |
| Pressure on specimen (psi) | | 130 | |
| Time at temperature (min) | | 5 | |
| Laminate thickness (inches) | .0108 | .0062 | .0065 |

*Each film was processed above the fusing temperature of the respective resins.

TE-5489 as supplied by DuPont contains a high temperature methyl-phenyl silicone oil. When the dispersion is dried to form a crumb and the crumb is pressed into a film in accordance with the method of Example 17E, the silicone oil saturates and coats the films and prevents adhesion to other components in hot pressed laminates. To remove this silicone, the cast film was chopped and washed in clean toluene in a Ross Mixer-Emulsifier, dried in an air circulated oven at 50° C., and re-pressed to a film. This was repeated four times and the resulting silicone-free film was used in making Example 25B.

The three examples are foils with durable, compressible polymeric coatings. Example 25B possessed a particularly soft yet resiliant coating very firmly bonded to the copper surface. The coating can be gouged with a knife but shows no tendency to delaminate even in boiling water. Example 25C has a somewhat less resiliant and softer coating than 25B, but appears equally resistant to delamination. Example 25A has coating characteristics similar to 25C, but was the most easily gouged of the three.

EXAMPLE 26

A piece of ordinary, 16 ga. cold rolled steel was abraded with 200 grit sandpaper on one side until the surface was bright and shiny and free of mill scale and rust. The surface was washed with reagent grade acetone, allowed to air dry, flooded with 6 normal sodium hydroxide solution, allowed to stand several minutes, washed with distilled water, and allowed to air dry. The surface was treated with silane and a polymer film comprised of resin derived from TE-5489 (silicone-free) was press laminated to it, in accordance with the method of Example 25B. The result was sheet steel with a soft, compressible, resilient coating; firmly bonded and when gouged with a knife showing no tendency toward delamination.

EXAMPLE 27

A piece of ⅛ inch window glass was washed with soap and water, washed with reagent grade acetone, immersed in 6 normal sodium hydroxide solution for several minutes, washed with distilled water, and allowed to air dry. The surface was silane treated and a film of silicone-free TE-5489 was press laminated to the glass substrate, essentially in accordance with the method of Examples 25B and 26, but using very low pressure, less than 50 psi on specimen, and beginning with the platens at room temperature, raising them to 550° F. over a period of approximately one half hour, and allowing them to air cool to room temperature over a period of several hours, thus avoiding thermal shock which might have broken the glass. The TE-5489 produced a resilient, 0.005 inch coating which did not delaminate in boiling water after 24 hrs. exposure.

EXAMPLE 28A

A thin extruded coating of PTFE was applied by paste extrusion to ECG 37 ⅓ fiberglass yarn. The jacketed yarn thus produced was woven into an approximately 14×15 count plain woven fabric weighing approximately 35 oz./yd$^2$ (about 60% of which is represented PTFE). Overcoat layers were applied as follows: Cast films of FMK-4-10-B were laminated to both sides of this substrate in a platen press at a pressure of approximately 280 psi. Platen temperatures of 700° F. were maintained for 5 minutes, followed by cooling to approximately 150° F. over a period of about 15 minutes, also under pressure. The resulting product weighed 41 oz./yd.$^2$, had excellent physical integrity, and was exceptionally flexible.

EXAMPLE 28B

A cast film of a 60/40 weight % blend of TE-3313 and fluoroelastomer (derived from L-9025) latex (obtained from 3M) was laminated to the substrate of Example 28A. The resulting product had a flexibility and integrity comparable to Example 28A.

EXAMPLE 28C

The woven substrate of Example 28A was given 8 semifuse passes through FMK-4-10-B followed by a final dry fuse pass. This resulted in a material 0.044 in. thick and weighing 52.4 oz./yd$^2$. The product had excellent integrity and was somewhat more flexible than Example 2A, even though it was 20 percent heavier and approximately 30 percent thicker. The material was subjected to physical testing with the following results: Trapazoidal Tear Strength, Warp Direction: 260 lbs. Elongation at 40 lbs./in. load, Warp Direction: 4.5%

EXAMPLE 29

A substrate of Style 15227 glass cloth was heat cleaned and impregnated with ET 4327 methyl phenyl silicone emulsion. An initial layer of perfluoroelastomer was applied in a single fuse dip operation through DuPont's TE-5506 experimental low crystallinity perfluorinated polymer in aqueous dispersion having specific gravity of 1.39.

A blend containing 104 parts by weight of TE-3313 (57.7 percent PTFE solids) and 154 parts by weight of KALREZ latex (26 percent perfluoroelastomer solids) was prepared. The mixture was evaporated to dryness in an air circulating oven operating at 90° C. and the resulting cake was chopped and washed several times in hot water in a Waring blender and again dried at 90° C. to yield a coarse, flaked crumb. Using the technique employed in making Example 17E, the crumb was pressed into a film and the film was laminated to the substrate. The substrate weighed 24.7 oz./yd.$^2$.

The film and the laminate were both pressed under the following conditions: platen temperature, 550° F.; force on platens, 20 tons (approximately 560 psi on film, 1100 psi on laminate); time at temperature, 3 min.

The resulting flexible product was approximately 0.040 in. thick, and exhibited good physical integrity, with a resilient, well-adhered, and tough coating.

EXAMPLE 30

A film was prepared from TE 5489 derived solids treated to remove silicone oil as described in Example 17E. 10 grams of toluene-washed crumb were pressed in a platen press between pieces of aluminun foil treated with a silicone mold release. The platens were operated at 325° F. under a force of 1 ton for one minute. Thereafter, the material was cooled under pressure.

The resulting film was placed on a piece of 100 percent polyester knit fabric, Style 5162, white, 1980 (manufactured by Armtex, Inc., Pilot Mountain, N.C.) and pressed essentially as described in Example 17K, but with a platen temperature of 325° F. and 10 tons of force on the platens for one minute.

A durable, flexible composite having a thickness of approximately 0.015 in. resulted. The knit reinforcement was thoroughly encapsulated by the perfluoroelastomer matrix.

EXAMPLE 31

Employing methods described in Example 30, 5 grams of TE 5489 solids were pressed into a film and laminated to one side of a piece of TYVEK spunbonded polyolefin, Style 1056D (manufactured by DuPont). Platen temperatures of 240° F. were employed to laminate the material and the work was pressed for 2 minutes with approximately 1 ton of force on the platens. After a 1 minute dwell at temperature and pressure, the material was cooled under pressure to about room temperature. The resulting laminate containing perfluoropolymer on one face (approximately 0.009 in. thick) was flexible and tough.

EXAMPLES 32 A&B

Employing methods similar to those described in Example 31, laminates of TE-5489 fluoroelastomer on two styles of REEMAY spun-bonded polyester (manufactured by DuPont) were prepared. Example 32A included DuPont Style 2431 reinforcement and Example 32B contained DuPont Style 2024 reinforcement. In both examples, pressing conditions were as follows: platen temperature, 335° F.; force on platen, 2 tons; time at temperature, 2 minutes; and cooling under pressure. Composites so produced contained perfluoropolymer on one face and polymer on the other. Moreover, the composites were flexible and tough.

EXAMPLE 33

Example 33 was prepared by using the materials and techniques employed in making Example 30, but with reduced laminating pressure to obtain a composite with perfluoropolymer on one face of the Armtex Style No. 5162 polyester knit. Pressing conditions were: platen temperature, 335° F.; force on platen, 1–2 tons; time at temperature, 1 minute; and cooling under pressure.

The resulting laminated composite at 0.012 inches of thickness was noticeably more flexible and conformable than that of Example 30. The polymer matrix was firmly bonded to the reinforcement, showing no tendency toward delamination.

EXAMPLE 34

Employing the techniques used in making Example 33, a single faced laminate employing resin derived from TE-5489 was produced on a 50/50 polyester/cotton interlock fabric, 1.85 yield at 60 inch width (Style No. 443833 produced by Burlington Industries, New York, N.Y.).

The resulting product was a durable, flexible and conformable laminate. The perfluoropolymer was firmly anchored to one side. The unlaminated side of the composite maintained its soft textile quality.

EXAMPLES 35 A&B

Examples 35 A&B were made using methods essentially similar to those used in making Examples 2A and 2B with the exception that Dupont VTR-5307 latex in the PTFE/fluoroelastomer latex blend was replaced with AFLAS TFE/propylene copolymer latex was obtained from Xenox, Inc., Houston, Tex. The blend was made by mixing 104 pbw of Dupont TE-3313 with 129 pbw of the AFLAS latex, thereby maintaining the 60/40 proportion of PTFE to fluoroelastomer. The composition of Examples 35 A&B is shown below:

| | Example 35A | Example 35B |
|---|---|---|
| reinforcement | 15227 glass cloth | 129 glass cloth* |
| component weight | 18 oz./yd.$^2$ | 6.6 oz./yd.$^2$ |
| reinforcement finish | silicone oil** | silicone oil** |
| initial layer | PTFE** | PTFE** |
| | 5 oz./yd.$^2$ | 1.0 oz./yd.$^2$ |
| overcoat layer | AFLAS/PTFE | AFLAS/PTFE |
| | 10.6 oz./yd.$^2$ | 2.6 oz./yd.$^2$ |
| topcoat | PTFE | PTFE |
| | 1.2 oz./yd.$^2$ | 0.6 oz./yd.$^2$ |

*Style No. 129 glass cloth, ECD 225 ½, plain weave, 38 × 40, 6.56 oz./yd.$^2$, manufactured by Chemical Fabrics Corporation.
**Reinforcement finish and initial layer applied simultaneously.

The physical properties of Examples 35 A&B are as follows:

| Property | Units | Example 35A | Example 35B |
|---|---|---|---|
| weight | oz./yd.$^2$ | 34.8 | 10.8 |
| thickness | in. | .030 | .009 |
| strip tensile strength | | | |
| warp | lbs./in. | 813 | 258 |
| fill | | 907 | 332 |
| trapezoidal tear strength | | | |
| warp | lbs. | 93 | 19 |
| fill | | 111 | 25 |
| tensile strength after fold | | | |

-continued

| Property | Units | Example 35A | Example 35B |
|---|---|---|---|
| warp | lbs./in. | 807 | not |
| fill | | 960 | tested |
| coating adhesion | lbs./in. | 12.1 | 5.3 |

EXAMPLES 36A–C

Example 36A was prepared by the following procedure: ECB150 4/3 fiberglass yarn was treated with silicone oil and impregnated with TE-5506 low crystallinity perfluoropolymer (DuPont) in a single application using a mixture of TE-5506 and ET-4327 emulsion (Dow Corning), followed by drying and fusing. The bath was prepared by mixing 199 pbw of TE-5506 (50.3% solids) with 23 pbw of ET-4327 (35% solids) and was diluted with water to a specific gravity of 1.225. The proportion of perfluoropolymer to silicone polymer in the bath was 12.5 to 1, by weight.

The impregnated yarn prepared according to Example 36A was woven into a 14×14 count fabric weighing approximately 20 oz/yd$^2$. The woven fabric was then baked at approximately 550° F. for 1 minute and used in preparing Examples 36B and 36C as follows. Example 36B was prepared by applying to the fabric of Example 36A an intermediate coating of PTFE/fluoroelastomer blend, weighing approximately 13 oz/yd$^2$, in 4 semi-fused passes through FMK 4-10-B. The coating was fused by baking for 1 minute at approximately 700° F. and an overcoat of PTFE was applied from TE-3313 (DuPont) diluted to a specific gravity of 1.30. The final weight of the example was 34 oz/yd$^2$.

Example 36C was prepared by applying to the fabric of Example 36A an intermediate coating of PTFE in 6 semifuse dip passes through TE-3313 at 1.485 specific gravity followed by calendering, dry fusing, and a final fuse dip through TE-3313 at 1.30 specific gravity. No overcoat layer was applied.

Examples 36B–C were subjected to physical testing and the following results were obtained:

| Test | Units | Example 36B | Example 36C |
|---|---|---|---|
| weight | oz./yd.$^2$ | 34.0 | 34.8 |
| thickness | in. | .035 | .033 |
| tensile strength | | | |
| warp | lbs./in. | 630 | 667 |
| fill | | 590 | 515 |
| tensile strength after fold fill | lbs./in. | 575 | 455 |
| trapezoidal tear strength fill | lbs. | 93 | 95 |
| coating adhesion | lbs./in. | 9.7 | 10.7 |

While representative applications and embodiments of the invention have been described, those skilled in the art will recognize that many variations and modifications of such embodiments may be made without departing from the spirit of the invention, and it is intended to claim all such variations and modifications as fall within the true scope of the invention.

We claim:

1. A composite having a low modulus of stiffness and good chemical resistance which comprises a substrate coated with a matrix comprising:

(a) an inital layer of a perfluoropolymer selected from the group consisting of a perfluoroplastic, a perfluoroelastomer, a blend of perfluoroplastic and perfluoroelastomer, or any combination thereof; and (b) an overcoat layer of a fluoroelastomer, a fluorelastomer/fluoroplastic blend, or any combination thereof.

2. A composite according to claim 1 wherein the initial layer comprises a perfluoropolymer and a lubricating agent.

3. A composite according to claim 1 wherein the substrate is treated with a coupling agent to promote bonding.

4. A composite according to claim 1 wherein said overcoat layer comprises a blend of a fluoroelastomer and a fluoroplastic, wherein the fluoroelastomer comprises from about 10% to about 90% by weight of the blend.

5. A composite according to claim 4 wherein said fluoroelastomer comprises from 25% to 60% by weight of said blend.

6. A composite according to claim 4 wherein an intermediate layer comprising a fluoroelastomer is interposed between said initial layer and said overcoat layer.

7. A composite according to claim 1, further comprising a topcoat selected from the group consisting of a fluoroplastic, a fluoroelastomer, and a fluoroplastic/fluorelastomer blend.

8. A composite according to claim 1 wherein resins in said layers are at least partially cross-linked.

9. A composite according to claim 1 wherein only one face of said substrate is coated with a matrix.

10. A composite according to claim 1 wherein said substrate is reinforcement material capable of withstanding composite formation temperatures.

11. A composite according to claim 10 wherein said substrate is a yarn, filament, monofilament, or other fibrous material.

12. A composite according to claim 10 wherein said substrate is a textile selected from the group comsisting of woven and non-woven materials.

13. A composite according to claims 1 or 12 wherein said substrate is selected from the group consisting of glass, fiberglass, ceramics, graphite, polybenzimidazole, polyaramides, PTFE metal, polyolefins, polyesters, polyamides, copolymers of TFE, polyether sulfones, polyimides polyether ketones, polyethenimides, novoloid phenolic fibers, natural and synthetic textiles.

14. A composite according to claims 1 or 7 wherein said fluoroelastomer is selected from the group consisting of copolymers of vinylidene fluoride and at least one other fluorinated monomer selected from the group comprising hexafluoropropylene; tetrafluoroethylene; chlorotrifluoroethylene; and pentafluoropropylene.

15. A composite according to claim 1 wherein said perfluoroplastic comprises PTFE, PFA or FEP.

16. A composite according to claim 1 wherein said perfluoroelastomer comprises a copolymer of TFE and perfluorovinylether such as PMVE or PPVE.

17. A composite according to claim 1 wherein one or more of the fluoropolymer components contains a functional group selected from the group consisting of carboxyl and sulfonic acid and salts thereof, halogen, and a reactive hydrogen on an alkyl side chain.

18. A composite having a low modulus of stiffness and good chemical resistance which comprises a substrate coated with a matrix comprising:

(a) an initial layer of a perfluoropolymer selected from the group consisting of a perfluoroplastic, a perfluoroelastomer, a blend of perfluoroplastic and perfluoroelastomer, or any combination thereof, said initial layer being applied as a relatively light coating to maintain a low stiffness modulus for the composite and to provide the substrate with chemical resistance; and (b) an overcoat layer of a fluoroelastomer, a fluoroelastomer/fluoroplastic blend, or any combination thereof.

19. A composite having a low modulus of stiffness and good chemical resistance comprising a substrate coated with a matrix comprising (a) an initial layer comprising a perfluoroplastic, a perfluoroelastomer or blends thereof, said initial layer being applied to the substrate in an amount sufficient to provide chemical resistance while at the same time leaving any openings in the substrate substantially open so as to maintain flexibility; and (b) an overcoat layer comprising a fluoroelastomer, or a fluoroelastomer/fluoroplastic blend.

20. A composite according to claim 19, wherein the composite has a flexural rigidity less than about 200,000 mg-cm.

21. A composite according to claim 19, wherein the initial layer comprises a perfluoropolymer and a lubricating agent.

22. A composite according to claim 19, wherein the substrate is treated with a coupling agent to promote bonding.

23. A composite according to claim 19, wherein said overcoat layer comprises a blend of a fluoroelastomer and a fluoroplastic, wherein the fluoroelastomer comprises from about 10% to about 90% by weight of the blend.

24. A composite according to claim 23, wherein said fluoroelastomer comprises from 25% to 60% by weight of said blend.

25. A composite according to claim 23, wherein an intermediate layer comprising a fluoroelastomer is interposed between said initial layer and said overcoat layer.

26. A composite according to claim 19, further comprising a topcoat comprising a fluoroplastic, a fluoroelastomer, and fluoroplastic/fluoroelastomer blend.

27. A composite according to claim 19, wherein said layers are at least partially cross-linked.

28. A composite according to claim 19, wherein only one face of said substrate is coated with the matrix.

29. A composite according to claim 19, wherein said substrate is reinforcement material capable of withstanding composite formation temperatures.

30. A composite according to claim 29, wherein said substrate is a yarn, filament, monofilament, or other fibrous material.

31. A composite according to claim 29, wherein said substrate is a textile selected from the group consisting of woven and non-woven materials.

32. A composite according to claim 31, wherein the initial layer is applied to individual fibers of the textile substrate prior to assembly of the substrate.

33. A composite according to claim 19 or 31, wherein said substrate is selected from the group consisting of glass, fiberglass, ceramics, graphite, polybenzimidazole, polyaramides, PTFE, metal, polyolefins, polyesters, polyamides, copolymers of TFE, polyether sulfones, polyimides, polyether ketones, polyethenimides, novoloid phenolic fibers, and natural and synthetic textiles.

34. A composite according to claims 19 or 26, wherein said fluoroplastic in the overcoat layer comprises PTFE, PFA or FEP.

35. A composite according to claims 19 or 26, wherein said fluoroelastomer is selected from the group consisting of copolymers of vinylidene fluoride and at least one other fluorinated monomer selected from the group comprising hexafluoropropylene; tetrafluoroethylene; chlorotrifluoroethylene; and pentafluoropropylene.

36. A composite according to claim 19, wherein said perfluoroplastic is the initial layer comprises PTFE, PFA or FEP.

37. A composite according to claim 19, wherein said perfluoroelastomer comprises a copolymer of TFE and perfluorovinylether such as PMVE or PPVE.

38. A composite according to claim 19, wherein one or more of the fluoropolymer components contains a functional group selected from the group consisting of carboxylic and sulfonic acids and salts thereof, halogen, and reactive hydrogen on a alkyl side chain.

* * * * *